United States Patent [19]

De Lancey

[11] 4,120,274

[45] Oct. 17, 1978

[54] CARBURETORS OR FUEL MIXING SYSTEMS

[76] Inventor: Warren H. De Lancey, 1580 Prospect Ave., Apt. H-4, Elyria, Ohio 44035

[21] Appl. No.: 584,203

[22] Filed: Jun. 5, 1975

[51] Int. Cl.[2] ..... F02M 69/00

[52] U.S. Cl. ..... 123/139 E; 123/139 AW; 123/139 BG; 123/140 MC; 261/50 A; 261/89; 261/90

[58] Field of Search ..... 123/139 E, 119 E, 140 MC, 123/32 AE, 119 R, 139 BG, 139 AW; 261/28, 50 A, 89, 90

[56] References Cited

U.S. PATENT DOCUMENTS

| | | | |
|---|---|---|---|
| 2,078,849 | 4/1937 | Grosjean | 261/50 A |
| 2,409,477 | 10/1946 | De Lancey | 417/199 X |
| 2,526,673 | 10/1950 | Kollsman | 261/69 R X |
| 2,595,719 | 5/1952 | Snyder | 261/89 |
| 2,851,025 | 9/1958 | Dahl | 123/140 MC |
| 3,036,564 | 5/1962 | Guiot | 123/140 MC |
| 3,263,662 | 8/1966 | Barth et al. | 123/140 MC |
| 3,286,998 | 11/1966 | Mennesson | 123/139 E X |
| 3,659,564 | 5/1972 | Suzuki et al. | 123/32 ST X |
| 3,777,727 | 12/1973 | Kirchner et al. | 261/50 A X |

*Primary Examiner*—Charles J. Myhre
*Assistant Examiner*—Tony M. Argenbright
*Attorney, Agent, or Firm*—Watts, Hoffman, Fisher and Heinke

[57] ABSTRACT

A fuel-air proportioning and mixing system for internal combustion engines is disclosed comprising a variable orifice for measuring the volume of air and a motor driven variable volume displacement pump for measuring and atomizing fuel. Changes in size of the variable orifice in response to variations of air volume furnishes energy to modulate the fuel supply to predetermined ratios with continuous correction for air temperature, humidity, and barometric pressure. Electric motor also provides energy to atomize the fuel and mix it uniformly with air passing to engine intake manifold. The fuel-air ratio is controlled from the most economical to the most powerful in response to engine output load.

A variation of the device to accommodate stratified charge engines provides two air fuel ratios — an ideal mixture for ignition, and a lean mixture automatically variable with torque requirements for the main combustion charge.

Other functions provided include automatic enrichment of mixture for cold starting, controlled deceleration of engine speed to prevent stalling, automatic enrichment of mixture if idle speed declines below a predetermined setting, curtailment of fuel supply while decelerating or coasting above a predetermined engine speed, and a complete cut-off of fuel supply with ignition to prevent dieseling. Since there is no float chamber, percolation and vapor lock are eliminated.

19 Claims, 63 Drawing Figures

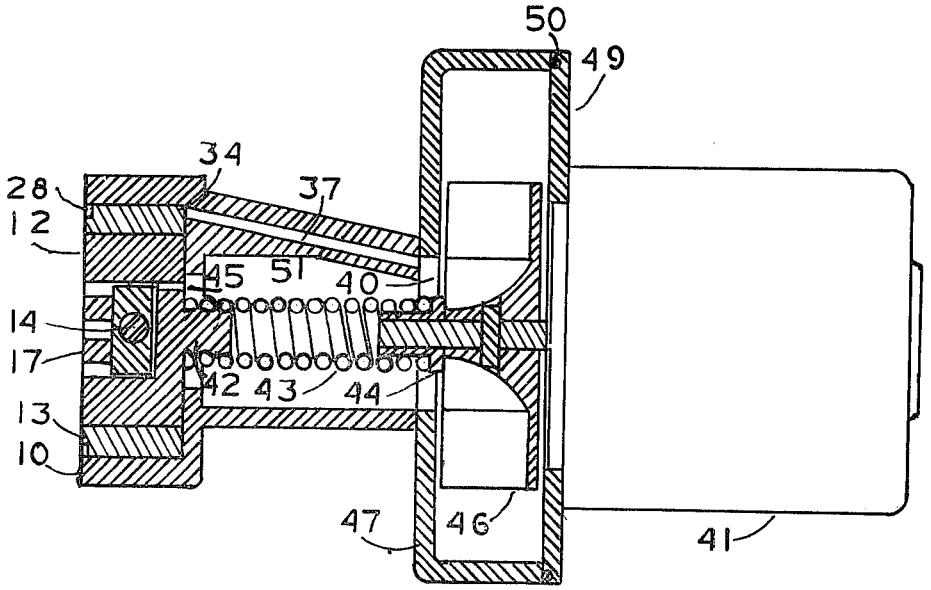
FIG. 15
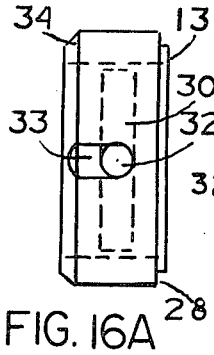
FIG. 16A
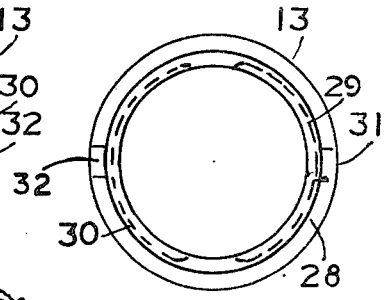
FIG. 16B
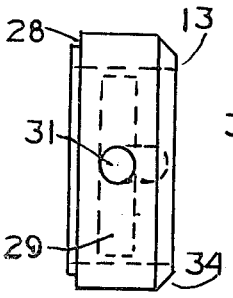
FIG. 16C
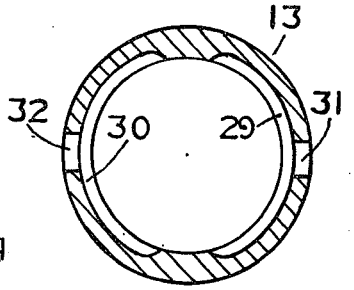
FIG. 16D
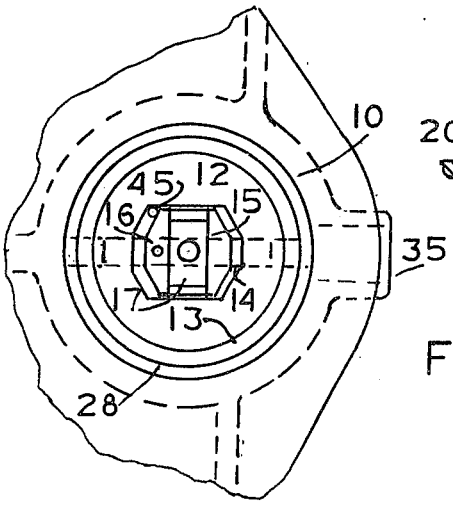
FIG. 17
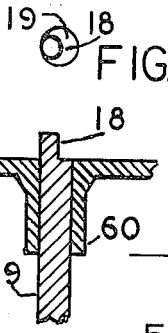
FIG. 18A
FIG. 18B
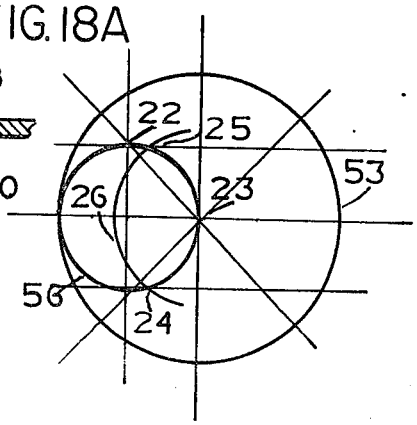
FIG. 19

FIG. 48
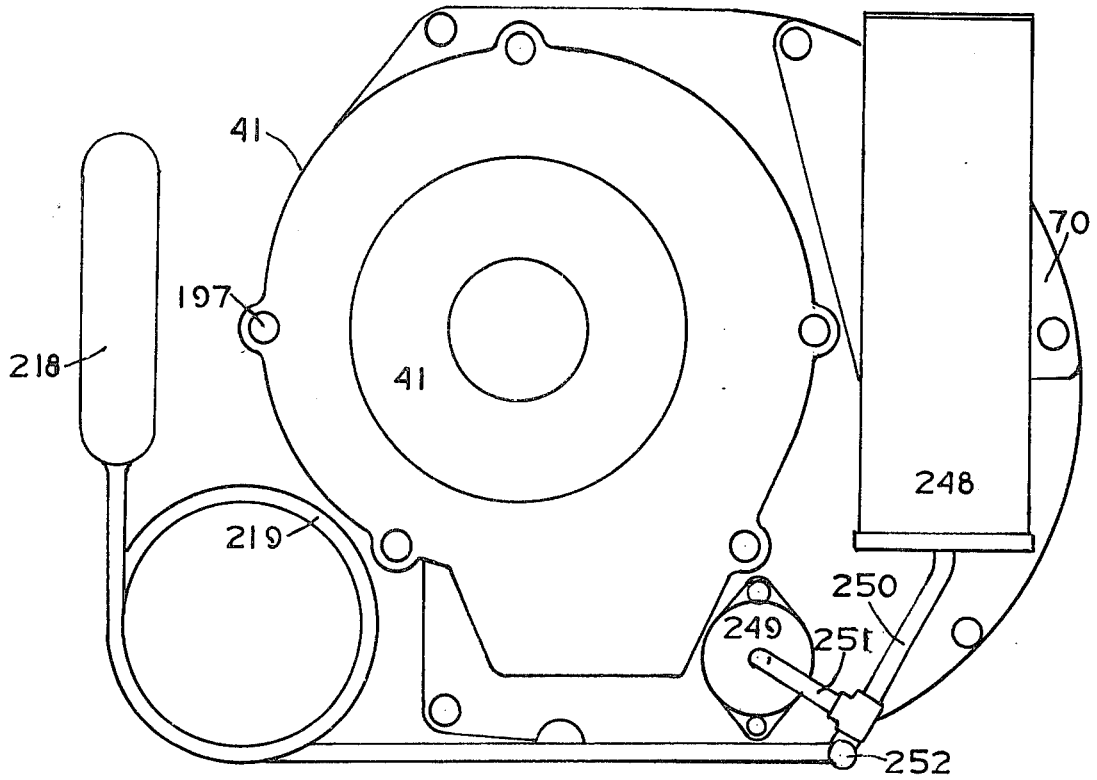
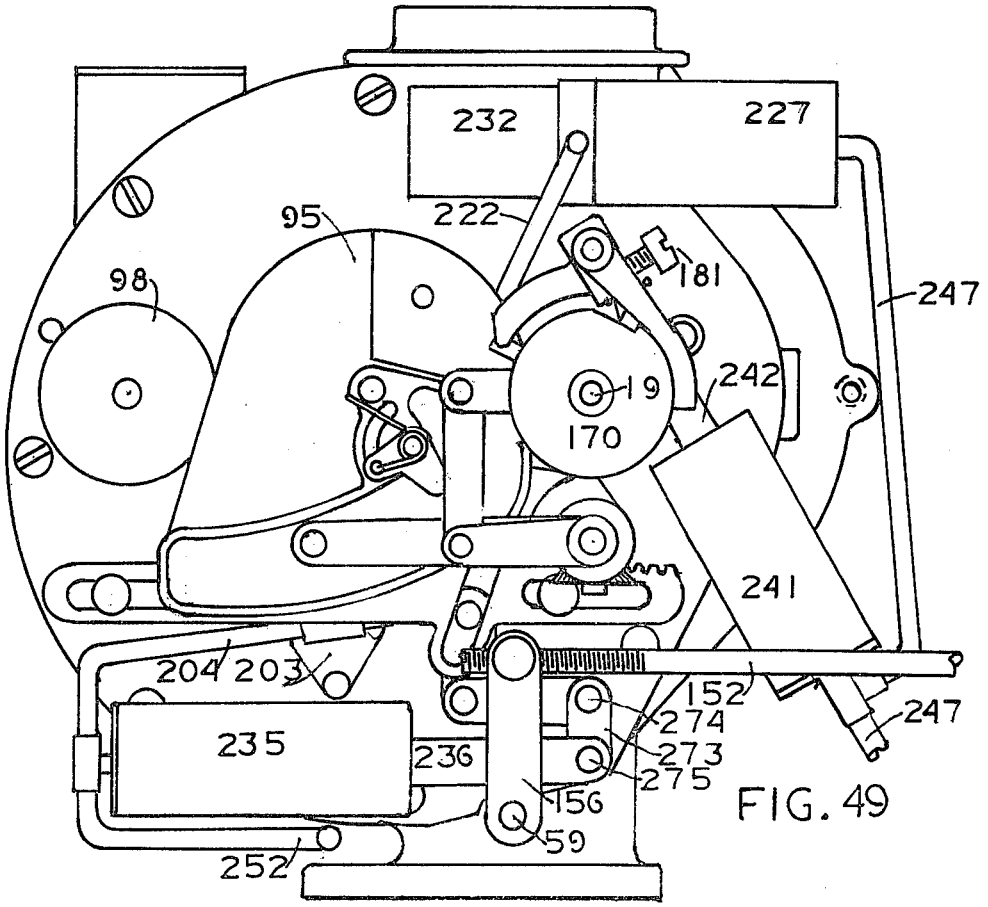
FIG. 49

CARBURETORS OR FUEL MIXING SYSTEMS

BACKGROUND OF THE INVENTION

1. Field of the Invention

With the rising costs of fuel for internal combustion engines and the growing concern over pollution of the environment, it is now generally recognized that the venturi-float chamber type of carburetor does not provide either the precise control of fuel-air ratio, the fine atomization or the uniform mixture for optimum results. Many refinements have been added, and some of the faults reduced, but in turn the structure has become more complicated and sensitive, while retaining major shortcomings. Multiple barrels have been incorporated to increase performance under load, while maintaining economy at low speeds. The net results have been a more complicated device considerably short of the ideal.

One proposed solution has been the electronically controlled fuel injection system. Here the air volume entering the intake manifold is measured, often by sophisticated means, corrected for temperature and pressure variables, and this data together with other such as engine speed and torque requirements fed into a computer type of electronic control. Fuel is supplied under pressure to nozzles where needle valves time and control fuel flow under direction of the electronic system. Needle opening may be less than a thousandth of an inch for a micro second. It has been reported that such systems are to be offered on American cars in the future at a cost of several hundred dollars additional. There is little in the official tests reports to indicate they substantially increase mileage or decrease pollution.

Another means suggested for achieving more accurate air-fuel ratios is to measure air flow to the manifold by passing it thru a venturi and using a transducer to measure volume by the degree of pressure drop or variation of flow pattern. This is then corrected for pressure and temperature, engine speed, torque, etc. and the resulting computation used to feed a continuous stream of fuel to an ultrasonic atomizer which discharges into the air stream going to the intake manifold. None of these systems offer the precise control of air-fuel mixture so important to meet the standards for economy and clean air currently being discussed, and they introduce service problems beyond the scope of the average vehicle mechanic.

It would also seem probable at the current state of the art that some sort of stratified charge engine, particularly if a simple dual ratio fuel system were available, would be the simplest and most effective way to provide both maximum fuel economy and meet clean air standards. Stratified charge require two separate air-fuel ratios - one which has excellent ignition characteristics, and another which is normally much leaner, but preferably should vary its mixture to meet torque demands on the engine. To meet these requirements, fuel injection systems become extremely complicated, and if the venturi-float chamber system is used, either two separate carburetors as in one successful car, or two separate venturis built into one housing would be necessary. A simple device to provide both mixtures in precise ratios with fine uniform mixture would be most helpful.

2. The Prior Art

There is a vast prior art on means of mixing fuel with air to furnish an explosive mixture for internal combustion engines. Almost exclusively these relate, however, to devices of the venturi-float chamber design or fuel injection systems of the basic diesel type which have been established in fundamental principle for almost a century. Mostly these have to do with attempts to improve operating deficiencies of the structures. While the use of variable orifices have been long used for measuring fluids, particularly in laboratories, the structure disclosed here is believed to be unique as is its generation of power for modulating a metering pump. Details of the pump are shown in De Lancey U.S. Pat. No. 2,409,477, and similar pumps were widely used for decades on air atomizing oil burners. The principle of atomizing liquid by contact with a high speed disc has likewise been long and successfully employed in the oil heating industry.

SUMMARY OF THE INVENTION

The present invention relates to a new and improved carburetor for internal combustion engines of the reciprocating or rotary type. It provides precise control of the air-fuel mixture under all operating conditions to maintain maximum economy and minimize environmental pollution. It is a simple mechanical device, comparing favorably in manufacturing cost with a venturi carburetor which could approach it in performance. It atomizes the fuel into fine, uniform particals under all operating conditions, and mixes it uniformly with the air entering the intake manifold.

In particular the new carburetor has no venturi, no float chamber, and in the preferred structure, no choke. Intake air is measured precisely by a variable orifice, which in the preferred embodiment as disclosed here, is a swinging vane operating in an enclosure and having a gradually increasing clearance thru all but the initial few degrees of its travel. This vane is balanced, and biased by a uniform torsion spring to the closed position where it is a relatively close fit in its housing. This fit remains uniform thru a short segment of its initial movement, then the clearance gradually increases, permitting incoming air to pass by it on the end and sides. Thus even the small amount of air required at engine cranking speeds causes considerable movement of the vane and exerts significant rotational force on its axis.

This rotational force is utilized to modulate the flow from a variable volume displacement pump driven by a small, constant speed electric motor operated from the battery-generator system of the vehicle and controlled by the ignition key. This transfer of motion is accomplished by a double cam and lever, one cam to provide the most economical fuel mixture, and one to provide the most powerful. Under normal torque requirements, the most economical air-fuel ratio is always provided, except during deceleration as noted below.

The active element in air for the combustion process is oxygen, and in any given volume of air the amount of oxygen can vary widely with the temperature, barometric pressure and humidity of the sample. If precise air/fuel mixtures are to be attained, it is mandatory that corrections be made for these factors at all rates of air induction. A relatively simple and rugged mechanical structure is disclosed for accomplishing this continuously under all operating conditions.

The electric motor which drives the fuel measuring pump also drives a small centrifugal air blower wheel which circulates air previously measured from the inside of the air measuring chamber to a point just above the inlet to the conduit leading to the engine intake manifold. Here it is discharged at relatively high velocity thru a series of apertures sized to give the most uniform distribution.

The output of the fuel measuring pump is discharged into the air stream entering the blower wheel above mentioned in such a manner that its pulsating nature is eliminated. Striking this high speed wheel in a partial vacuum, striking the wall of the enclosing volute, and passage thru the volute and discharge apertures in association with high velocity air gives a high degree of atomization to the fuel, largely independent of its volatility and engine speed. Explosive mixtures can, therefore, be obtained with less volatile fuels, and a high degree of atomization obtained even at cranking speeds.

Enrichment of mixture for cold starting can be provided with the usual bi-metal thermostat increasing the pump setting by over riding the normal setting provided by air measurement. This thermostat ceases to function once the engine is up to safe operating temperature.

Rapid deceleration of the engine to prevent stalling is dampened by the mass of the air measuring vane and its attending cam, counterweight, and mechanism. These can be made heavier or lighter to obtain the desired degree of speed change.

As engine speed drops down to idle, the cam roller modulating the fuel pump at the point which would normally be "hot idle" meets an abutment which it must override in order to decrease fuel supply further. Any additional decrease of engine speed will considerably increase fuel supply with a richer mixture. The mixture will, therefore, automatically adjust itself to maintain idle speed regardless of conditions, and most stalling, particularly on start-up, turns, rapid braking etc. will be eliminated. The abutment is collapsible, and only increases mixture richness when going from a higher to a lower speed, and not the reverse.

The carburetor here disclosed has no float chamber, the fuel line being directly connected to the positive displacement, variable capacity fuel measuring pump. This line would supply fuel under sufficient pressure to prevent percolation and vapor lock, but would be internally vented to the supply system to prevent excessive pressure build up. Since the motor driving the pump is actuated by the ignition switch, the fuel supply stops completely with ignition switch-off, and eliminates any possibility of dieseling.

It is desirable that the fuel supply be curtailed while decelerating or at other times as when going down grade and little or no torque is required. This should only be above a certain minimum speed to prevent stalling. The structure shows two means of accomplishing this, either from the position of the accelerator pedal or from torque sensing means.

A minor modification of the carburetor is shown to provide two separate mixtures for stratified charge engines. These engines because of their reduction of pollutants and higher economy are predicted for considerable increase usuage, and an inexpensive system to provide dual mixture ratios would be helpful to their popularity. It will be noted that the carburetor here disclosed requires no choke as fuel supply is independent of vacuum. Some stratified charge carburetors have no throttle valve, and run on very lean mixtures for the main charge at low speeds. This eliminates carbon monoxide almost completely. The carburetor here disclosed can operate with or without a throttle valve to intake manifold.

A butterfly throttle is added to the inlet to the motor driven centrifugal blower to modulate the amount of air passing thru this system. This throttle is controlled by the position of the air measuring cam lever thru a cam of its own to maintain a constant, predetermined air-fuel ratio in this blower discharge. A discharge opening is added to the blower volute for conducting this mixture to the chambers adjacent to the spark plugs for most efficient ignition. It will be noted that the corrections for barometric pressure, temperature and humidity apply equally to this mixture which otherwise remains constant regardless of torque variations, although it can be enriched for cold starts.

On a stratified charge engine, the main charge is usually very lean beyond good ignition characteristics from a spark plug, and dependent for ignition on the rich charge surrounding that plug. The engine and vehicle, however, are so coordinated that the combustion of these two charges will comfortably maintain cruising speed on a level road operating with maximum fuel economy and minimum pollution. However, if more torque is required as in ascending a grade it may be desirable to enrich the lean mixture up to the point of maximum power, and provisions are made in the structure for this change.

The carburetor here disclosed, therefore, provides in a simple, rugged structure a means for precisely measuring air volume and correcting the measurement for major variables, a precise means for measuring fuel volumetrically and without the use of an atmospheric float chamber, interlocking means between the air measuring device and the fuel measuring device so that fuel-air ratios are maintained from most economical up to a maximum most-powerful depending on required torque, but with a most-economical bias; and a fuel atomizing means which assures fine uniform division and mixture largely independent of fuel volatility-or engine speed. Also provided is a means of supplying two air fuel ratios for stratified charge engines, one a rich mixture with maximum ignition characteristics maintained regardless of speed, barometric pressure, temperature or humidity, and the other a normally lean mixture for the principle charge, which can be enriched if torque requirements make that desirable.

Additional advantages and features of the invention will become apparent from the following description of the preferred embodiment made with reference to the accompanying drawings which form a part of the specifications.

BRIEF DESCRIPTION OF DRAWINGS

FIG. 15 is a section thru the fuel metering pump showing motor (not sectioned), blower, flexible drive, and a fuel discharge duct.

FIGS. 16 A,B,C, and D are views of the pump liner ring showing pump ports and ducting. View 16D is a section thru porting.

FIG. 17 is a front view of the fuel metering pump with cover removed.

FIGS. 18 A and B is the pump adjusting shaft and eccentric.

FIG. 19 is the geometry of the pump adjusting eccentric.

FIG. 48 is an elevation of rear cover with hydraulic barometric and humidity controls in place.

FIG. 49 is a front elevation with hydraulic controls in place.

DETAILED DESCRIPTION OF PREFERRED EMBODIMENT

Figure 1:
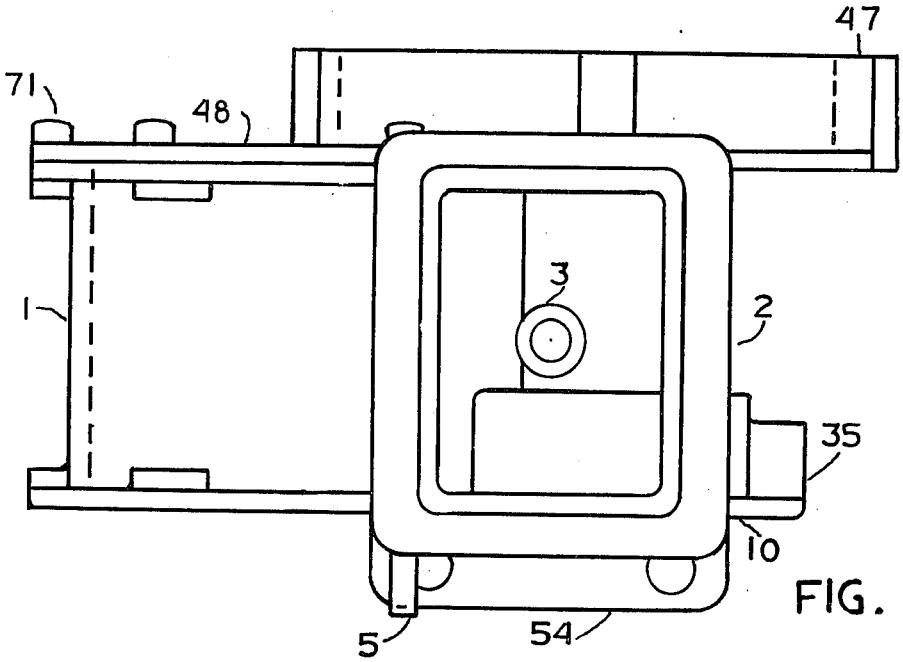
FIG. 1 is a plan view of the carburetor looking down at the air inlet with front cover removed and rear cover only in place.

The construction will be disclosed by describing the various operating components, and then assembling these into a finished structure. FIG. 1 is a top view of the main body or housing 1 with the rear cover 48 only in place. This view shows the flanged inlet port 2 on which the air filter mounts, and the boss 3 into which the filter retaining stud (not shown) is attached.

Figure 2:
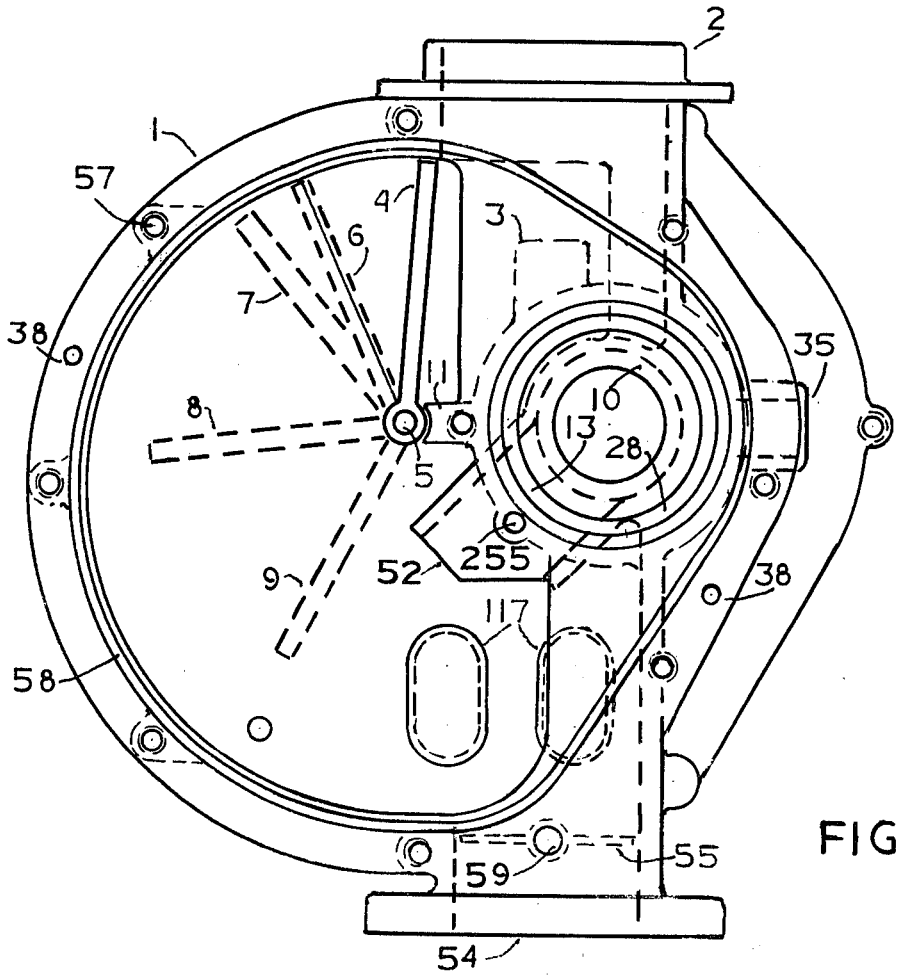
FIG. 2 is a front elevation with main chamber cover and control mechanism removed to show air measuring vane action and fuel pump cavity.
Figure 5:
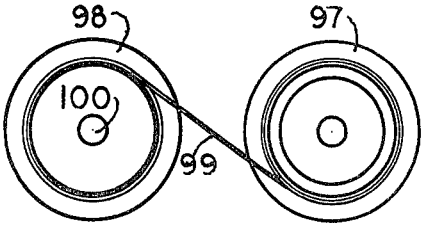
FIG. 5 is a view of the constant torque spring for biasing cam and air measuring vane.
Figure 7:
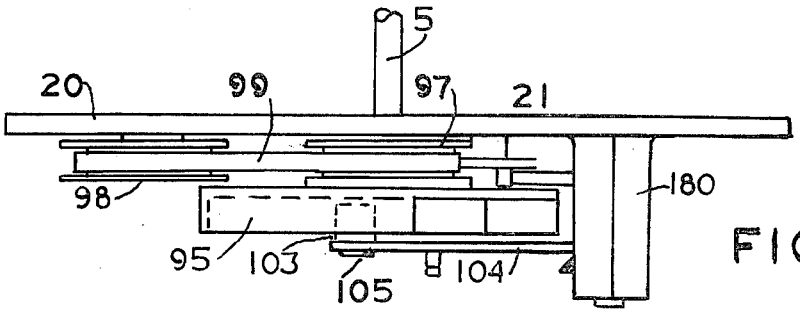
FIG. 7 is a top view of the front cover showing relationship of some of pump control mechanism.

FIG. 2 is a front elevation of the body 1 with its cover 20 removed to show the air measuring mechanism and its relation to the fuel metering pump. It should be understood that the terms "front" and rear are arbitrary and are here used merely for convenience. FIG. 2 shows at the left an arctuate shell, flanged on both sides, with a series of tapped screw holes 57 around the outer edge, and an "O" ring groove 58 on each flange face just inside the screw holes to seal the covers liquid tight. At the extreme lower part of FIG. 2 is the outlet flange 54 which is mounted to the intake manifold of the engine, and just above this the throttle valve 55 (shown in dotted outline) and its actuating shaft 59. The fuel pump cavity 10 is shown with its liner 13 in place, and fuel inlet boss 35 and its relationship to the structure can be seen in both FIGS. 1 and 2. Near the center of housing 1 FIG. 2 is a shaft 5 journalled in front and rear end covers 20 and 48, and free to turn on its axis. To this shaft is fixed a solid rectangular vane 4 which is free to revolve with shaft 5 thru almost a half circle, except for a slight bias to the rest position shown at 4 which is provided by a constant torque spring on the front cover 20, FIGS. 5 and 7. This vane has thin shim washers (not shown) at its hub around shaft 5 which form spacers and provide a slight clearance from both end covers when these are in place, and prevent the vane from otherwise contacting them. The inner surface of body 1 at the extremity of this vane is a radius swung from the axis of shaft 5 for a distance of about 15° from the inlet opening 2, and is then swung from a point to give a gradually increasing clearance between vane end and body wall as its circular travel is continued. Front and back covers 20 and 48 are likewise relieved a small fraction of an inch after the initial travel, but then remains with constant clearance. There is an abutment 11 which fits closely around the vane hub, but does not contact it, and forces the air drawn into inlet opening 2 by the pumping action of the engine to move the vane 4 around axis 5, and establish a sufficiently large orifice for its passage to outlet 54, maintaining on the vane only the constant pressure necessary to overcome its bias. The vane 4 would assume a position as shown by dotted outline 6 at cranking speed, at outline 7 at idle speeds, 8 at cruising speeds, and about position 9 at wide open throttle. These positions of course, depend on the air volume, vane bias, and clearance provided in the various positions, but these factors can be adjusted to give substantially the results shown.

The metering pump cavity 10 has the pump rotor and piston removed, but shows the hardened steel ring 13 within which the rotor revolves. This pump is similar to that described in De Lancey U.S. Pat. No. 2,409,477. It is shown in detail in FIGS. 15, 16, 17, 18 and 19. There is a cup shaped rotor 12 which is a close fit, but free to rotate in pump liner 13. The rotor has a close fitting cylindrical piston 14 on the axis of one of its diameter and about midway on the face as viewing the edge of the cup. This piston passes thru the hollow cavity of the cup where a yoke 15 is secured to it by a pin 16. When this yoke is in the center of the rotor cavity, the ends of the piston 14 are equal distance from the circular surface of the rotor 12. This yoke is preferably octagonal in shape and free to move with the piston a limited distance in either direction bringing the ends of the piston almost but not quite flush with the outer circumference of the rotor 12.

The yoke 15 has a rectangular channel FIG. 17, across the center of its face at right angle to the axis of the piston and extending in depth almost to the piston wall. Into this channel a rectangular slide 17 is closely fitted, but having sufficient clearance at its ends to move slightly more than the total movement of the piston. This slide has a central cylindrical opening into which closely fits a projection 18, FIG. 18B which is integral with, but an eccentric extension of, adjusting shaft 19, FIG. 18A. This shaft is mounted in a bearing which is integral with front cover 20, and as it is revolved thru an angular distance of 90 it is so located that the projection 18 moves from the center of the rotor axis to a position half the maximum piston stroke length in distance. The geometry of this movement is disclosed in FIG. 19 which has an enlarged scale. The pin 18 is represented by the circle 56. The pump rotor axis is represented by point 22, the adjusting shaft axis by point 23. As the adjusting shaft is turned, the axis of 18 moves along the arc 26 from 25 to 24. When the rotor 12 is revolved, the slide 17 revolves with it around pin 18. If the pin and rotor axis are concentric, yoke 15 and piston 14 to which it is attached have no movement, but as pin 18 is moved away from pump axis 22, the yoke 15 and piston 14 must oscillate in the rotor 12 as their positions are controlled by the pin 18. This oscillation forms a pumping action which is infinitely adjustable between zero and the maximum, and is a function of stroke length and piston diameter.

The rotor 12 revolves in a hardened steel annular ring 13, FIGS. 15, 16 and 17 which is pressed tightly into main body 1. This ring has a notch 28 on the outer face which forms an "O" ring groove for sealing the pump when pressed into place. On the inner surface of the ring are two arctuate grooves 29 and 30, best shown in the section FIG. 16D which are in the plane of rotation of the piston when in place, and form respectively the inlet and outlet ports. These grooves are of equal length and depth and separated by a distance slightly greater than the diameter of the piston 14. Inlet groove 29 is connected to the outer circumference of the ring by opening 31, FIG. 16D which, when ring is assembled in place, forms an extension of conduit in hollow boss 35 which is threaded at its outer end to receive conduit fitting for the fuel supply.

The discharge groove 30 is likewise connected to the outer circumference of ring 13 by opening 32 FIG. 16A, and by groove 33 to bevel 34. This bevel forms a conduit to distribute the fuel pumped around the entire circumference of the ring 13, but the ring is pressed tightly against the bottom of pump cavity 10 so that there is no substantial leakage as the discharge flows thru conduits 37 where it is discharged against the spinning fan 46. There is a small opening 45, FIG. 17, thru the web forming the bottom of cup shaped rotor 12. Leakage passing the front face of rotor 12 will be thrown by centrifugal force thru this opening which also keeps a slight vacuum on bearing of adjusting shaft 19.

Figure 23:
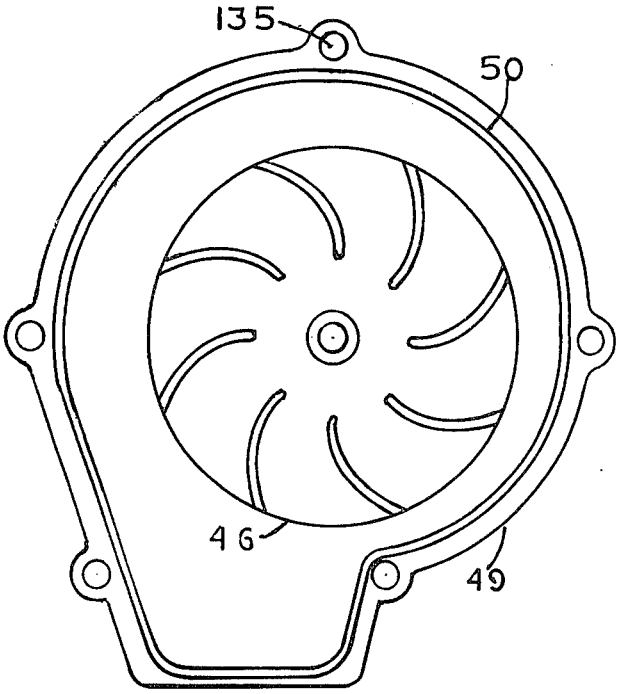
FIG. 23 is the volute closure for rear cover with blower wheel in place.
Figure 24:
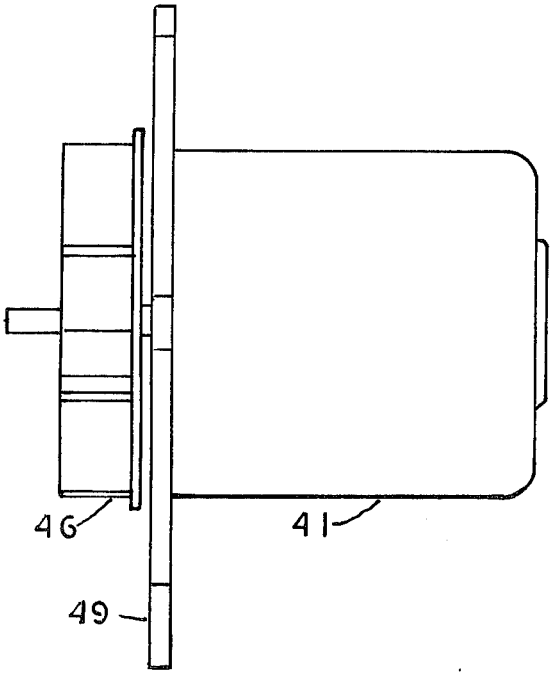
FIG. 24 is side view of the volute closure for rear cover with motor and blower wheel.

FIG. 15 shows a section thru the pump and its drive train. The electric motor 41 is not shown in section as this is a standard component commercially available. It is a direct current motor driven by the battery-generator system of the vehicle and runs at all times when the ignition switch is turned on. The speed of this motor is stabilized by electronic means, and preferably remains at about 3000 R.P.M. regardless of battery output including engine cranking when voltage is low. The pump rotor 12 has a threaded boss 42 on its inner face and concentric with its axis. A spring 43 is screwed onto this boss in the direction of rotation and also onto a ferrule 44 at its inner end. This ferrule slips over the end of the motor shaft and locks to the flat of the shaft by having a central opening of the same contour. The motor therefore when turning drives the pump rotor by means of spring 43 acting as a flexible coupling. The motor also has secured to its shaft a blower wheel 46, FIGS. 15, 23, and 24 which rotates in a volute 47 which is a part of rear cover plate 48, and this volute has a closure plate 49 FIGS. 15, 23, 24, and 30 on which the motor is mounted. This closure plate has an "O" ring groove 50 which tightly seals it when fastened in place with its screws 197 passing thru a multiplicity of holes 135, FIGS. 23 and 30.

Between the pump cavity 10 and the rear cover 48 is a cylindrical cavity 51, FIG. 3, which has a rectangular inlet 52, open to the main body below the air measuring vane. As the blower wheel revolves it draws air thru this inlet and cylindrical cavity and opening 40 and discharges it into the volute 47 with considerable velocity. Liquid fuel from the metering pump is discharged thru multiple openings 37 into the air stream entering the blower wheel where it is atomized by the high velocity wheel and air stream. The pump inherently has a pulsating discharge rising from zero to maximum and back to zero twice per revolution, but by spacing these phases against the synchronous blower wheel they reach the volute in essentially a continuous and unfluctuating stream.

Figure 20:
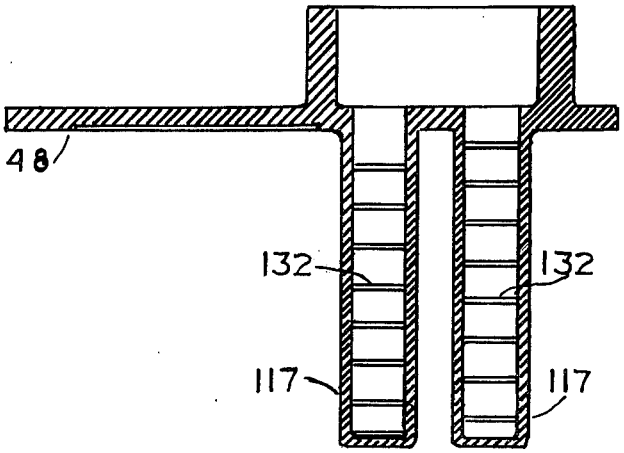
FIG. 20 is a section thru lower part of volute and mixture discharge tubes of rear cover.
Figure 21:
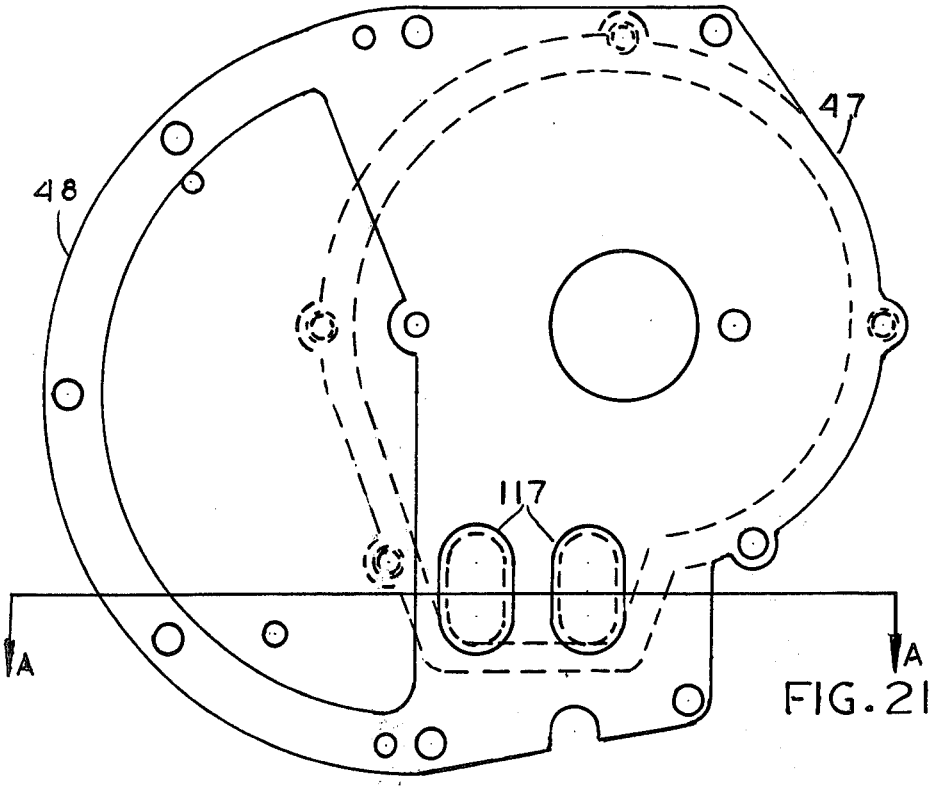
FIG. 21 is an inside view of rear cover.
Figure 22:
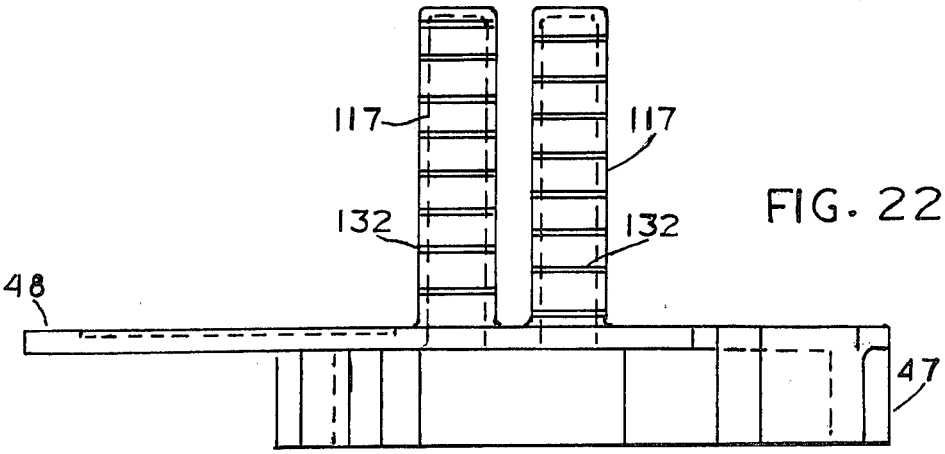
FIG. 22 is a bottom view of rear cover showing construction of air-fuel discharge tubes.

The rear cover plate 48, FIGS. 20, 21 and 22 has two oval tubes 117 extending perpendicular from its face, closed at the outer end and opening into the lower part of the volute at their inner end. The lower side of these tubes as viewed in FIG. 20 have a series of narrow saw slots 132 in their face and staggered from tube to tube. When the rear cover 48 is in place on body 1 these oval tubes are directly over the manifold flange opening 54 with its throttle valve 55. The mixture of air and atomized fuel thrown into the volute 47 passes thru these tubes and is discharged out the slots. By varying the size and the position of these slots a uniform dispersion of the mixture can be obtained. The rear cover 48 and its attached parts are secured to main body 1 by a plurality of screws 71 holding it liquid tight against "O" ring 58.

Figure 8:
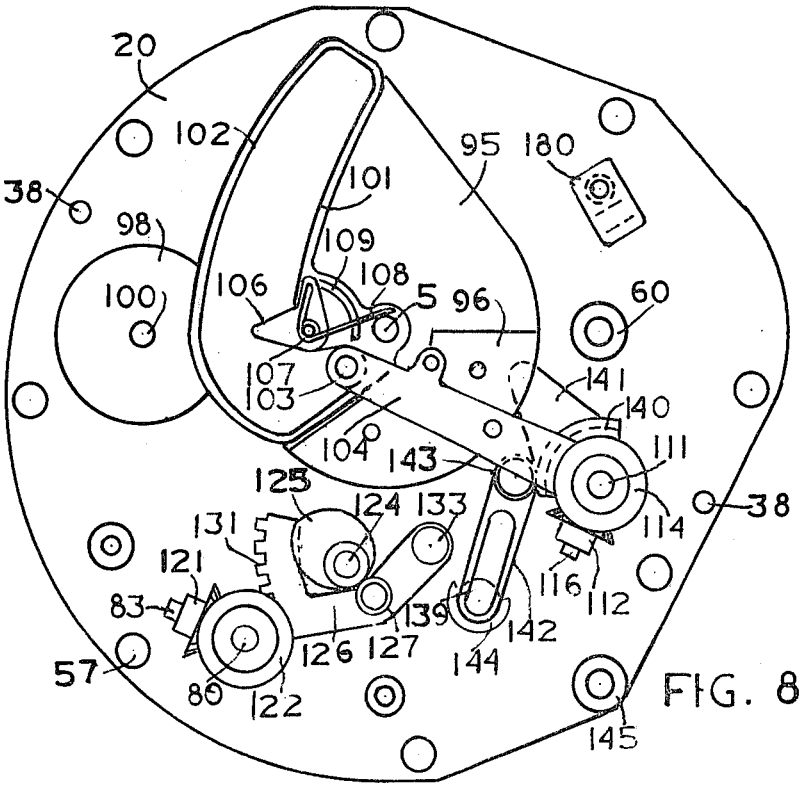
FIG. 8 is a view of the front cover and partial assembly of pump control mechanism.

The discharge rate of the fuel metering pump is infinitely variable from zero to maximum and is controlled and actuated by the air measuring vane 4 in the following manner: FIG. 8 shows an elevation of the front cover 20 with the linkage partially assembled so some of the components which would normally be hidden can be seen. The front cover 20 is secured to body 1 by a suitable number of screws 39 against a fluid tight "O" ring 58 and accurately located by dowels 38. The front cover 20 forms one bearing for shaft 5 which has mounted on it cam 95, preferably of some light weight die cast material. This cam has attached to it a balance weight 96 which statically balances both cam and vane 4. On the back side of this cam 95 is a torsion spring FIGS. 5 and 7 consisting of two spools 97 and 98 and coiled spring 99. Spool 97 is fixed to, and forms part of cam 95, while spool 98 is free to turn on its axis 100. Springs of this type provide a very constant torsion thruout their working range, and this one is so proportioned to return vane 4 to the rest position as shown in FIG. 2 and cam 95 as shown in FIG. 8 under all normal conditions when the engine is not pumping air.

Figure 6:
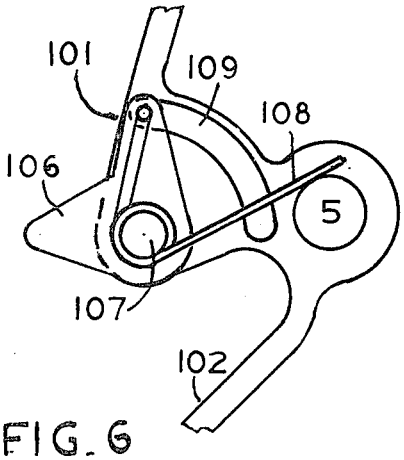
FIG. 6 is an enlarged view of collapsible abutment for controlling idle speed.
Figure 9B:
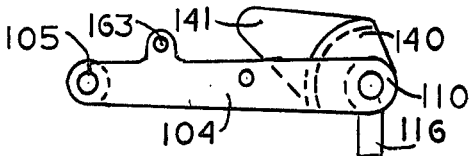
FIG. 9 shows two views of the cam, roller and arm for transferring motion from main cam.
Figure 9B:
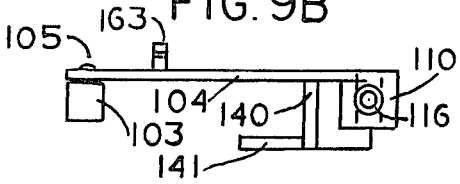
Figure 11:
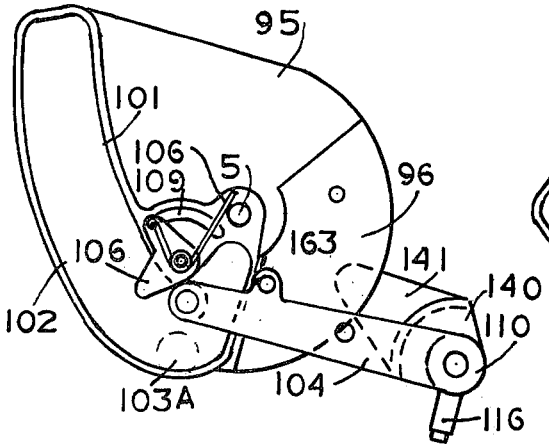
FIG. 11 shows the main cam arm and roller in cranking position.
Figure 12:
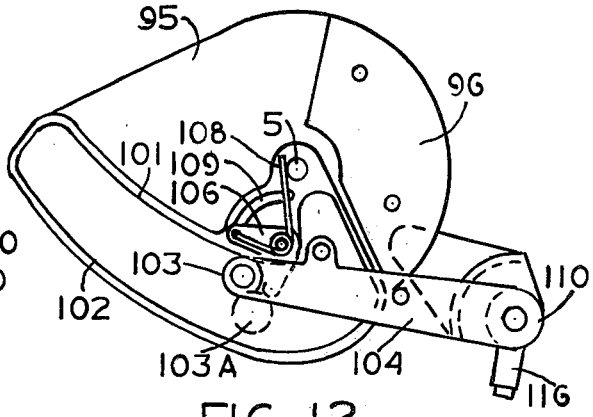
FIG. 12 shows the main cam, arm and roller idle position.
Figure 13:
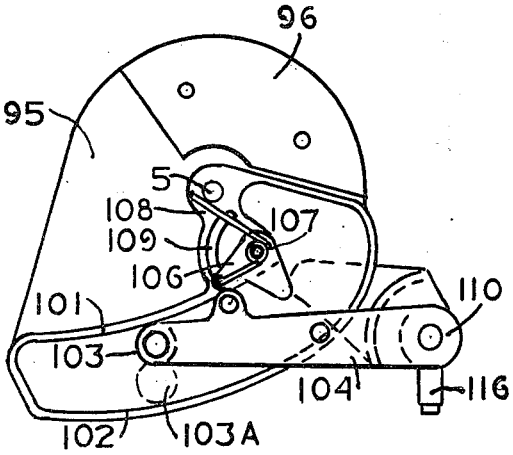
FIG. 13 shows main cam, arm and roller in cruising position.
Figure 14:
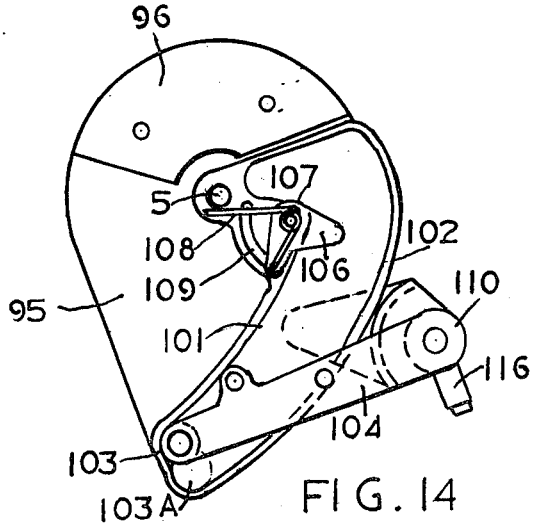
FIG. 14 shows main cam, arm and roller at wide open throttle.

Cam 95, FIG. 8, actually consists of two cam surfaces 101 and 102 which are contacted by a roller 103 FIG. 9 secured to the end of arm 104 by pivot 103 and the assembly pivots on stud 111 rigidly fixed to boss 21 in front cover 20. As will be explained below, arm 104 is biased by a spring in the clockwise direction which normally keeps roller 103 in contact with surface 101, but high torque requirements on the engine can overcome this bias and cause roller 103 to contact surface 102, or assume a position at any point between. FIGS. 11, 12, 13 and 14 show the positions the roller assumes as the cam turns with shaft 5 in response to air volume as measured by vane 4. FIG. 11 is the normal cranking position. FIG. 12 is normal hot idle. FIG. 13 is normal cruising and FIG. 14 is wide open throttle. On cam surface 101 is a hinged abutment 106, FIGS. 6, 8, and 11 which is formed of sheet metal and pivoted around an axis 107. It is biased in a counter-clockwise direction in the view shown by a spring 108 which has one or more loops around pivot 107, one arm restrained by an extension of shaft 5, the other passing thru a hole in abutment 106 into an arctuate groove in the face of the hub of cam 95. This groove limits the motion of abutment 106 around pivot 107. As cam 95, FIG. 11, turns in a counter clockwise direction the roller as previously explained due to the bias on arm 104 tends to follow cam surface 101. On striking this abutment from the cranking position side the roller will cause it to collapse and continue to contact surface 101. However, once past this abutment, if direction of rotation of cam 95 should be reversed, roller 103 on striking abutment 106 must over ride it. This causes a considerable movement of lever arm 104, and an increase of fuel supply as will be described below. As cam roller 103 is resting on surface 101 next to abutment 106 in the hot idle position FIG. 12, any lowering of engine speed immediately increases fuel supply, eliminating most stalling.

FIG. 11 shows the cam 95 and roller 103 in the normal starting position. Roller outline 103A shows the roller positioned for a maximum cold start. FIG. 12 shows the roller and cam relationship for hot idling. Any further slowing of engine would cause roller to rise on abutment 106 with an increase of fuel supply stabilizing engine speed. This would probably occur on cold idle. FIG. 13 shows cam and roller relationship for cruising on most economical air fuel ratio. 103A represents the cruising position under load as when ascending a grade. FIG. 14 represents cam and roller position at wide open throttle.

It will be seen that cam 95 imparts an angular motion to lever arm 104 thru roller 103, and that the relationship of this angular motion to that of the cam, and therefore air measuring vane 4, is controlled by the cam contour. Moreover while arm 104 is biased to contact surface 101, if this bias were overcome, arm 104 could be given additional motion at any one point up to a given limit defined by cam surface 102, but not beyond. Also in dropping down from a cruising position as shown in FIG. 13 to an idle position as shown in FIG. 12, the roller meets a sharp abutment and further movement of the cam 95 in response to a decreasing pumping action of the engine will cause abrupt angular motion of arm 104 with a corresponding increase of fuel as described below. FIG. 8 shows the cam and roller in the position they assume when engine is not running even though ignition is on, and fuel measuring pump is operating. Here arm 104 is locked in this position and cannot move, until cam 95 moves.

Figure 31:
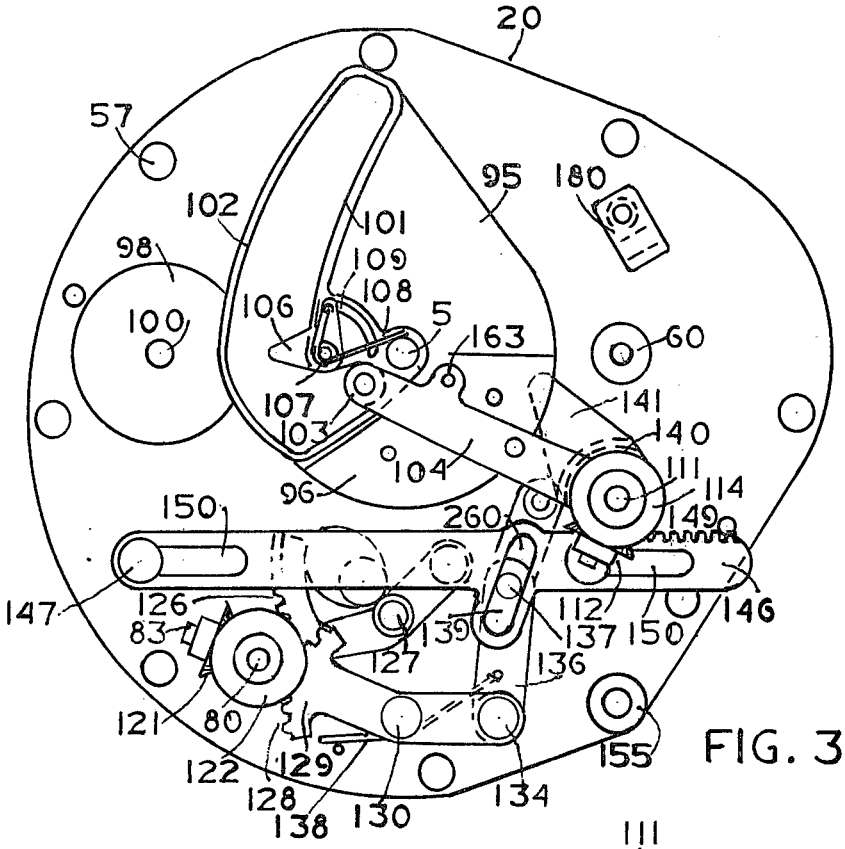
FIG. 31 is an elevation of front cover showing temperature compensation mechanism and mechanism to combine and proportion compensation for air pressure, humidity and temperature.
Figure 32:
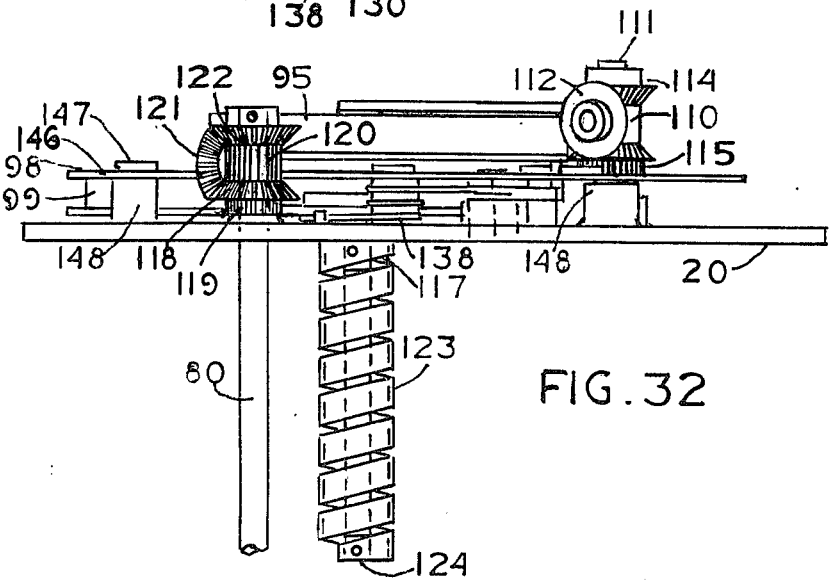
FIG. 32 is a bottom view of FIG. 31 showing temperature sensor helix and drive mechanism.
Figure 33:
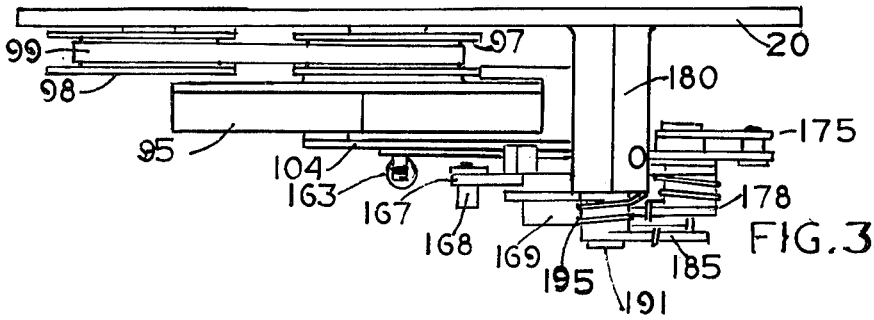
FIG. 33 is a top view of pump control mechanism mounted on front cover.
Figure 35:
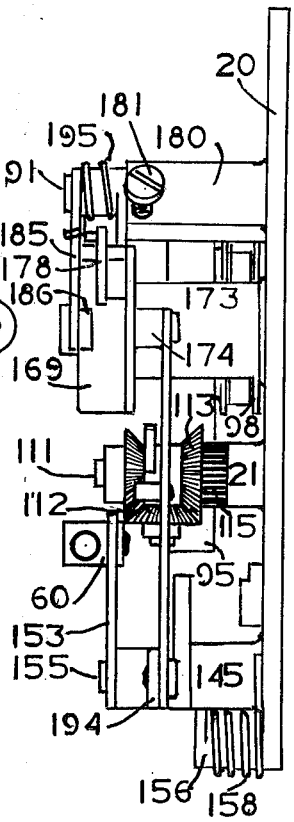
FIG. 35 is right side view of front cover with throttle control and main cam drive to fuel pump.
Figure 36:
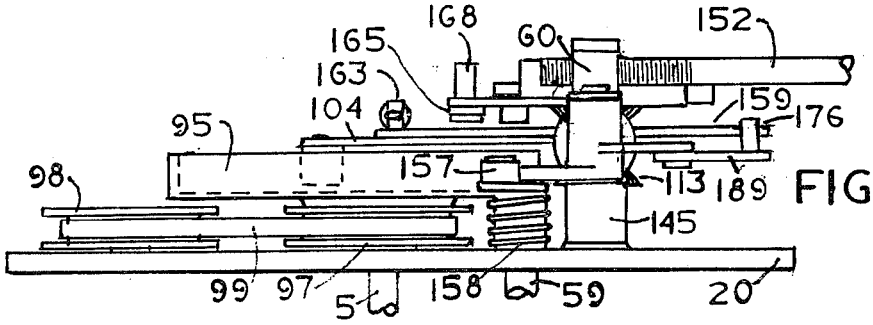
FIG. 36 is a bottom view of throttle control and main cam drive to fuel pump.
Figure 37D:
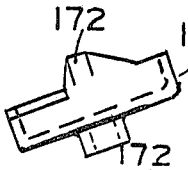
FIGS. 37A, B, C and D shows four views of the fuel pump actuating disc.
Figure 37A:
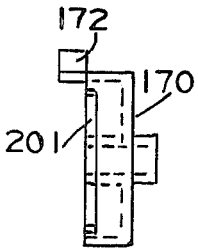
Figure 37B:
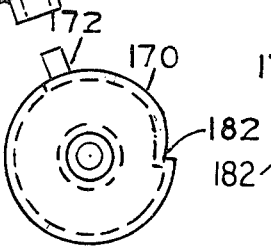
Figure 37C:
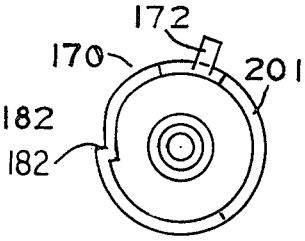

As shown most clearly in FIGS. 9, 31 and 32 lever arm 104 has a hub 110 which is pivoted on a stud 111. This stud FIG. 35 is securely pressed into a boss 21 on cover 56. Hub 110 also carries on a protruding stud 116 FIG. 11 bevel gear 112 which is free to turn on this stud. Bevel gear 112 with bevel gears 113 and 114 mounted on stud 111 form a differenial for combining the motions of the air volume registering arm 104, and the various correction factors to be described below.

Figure 34:
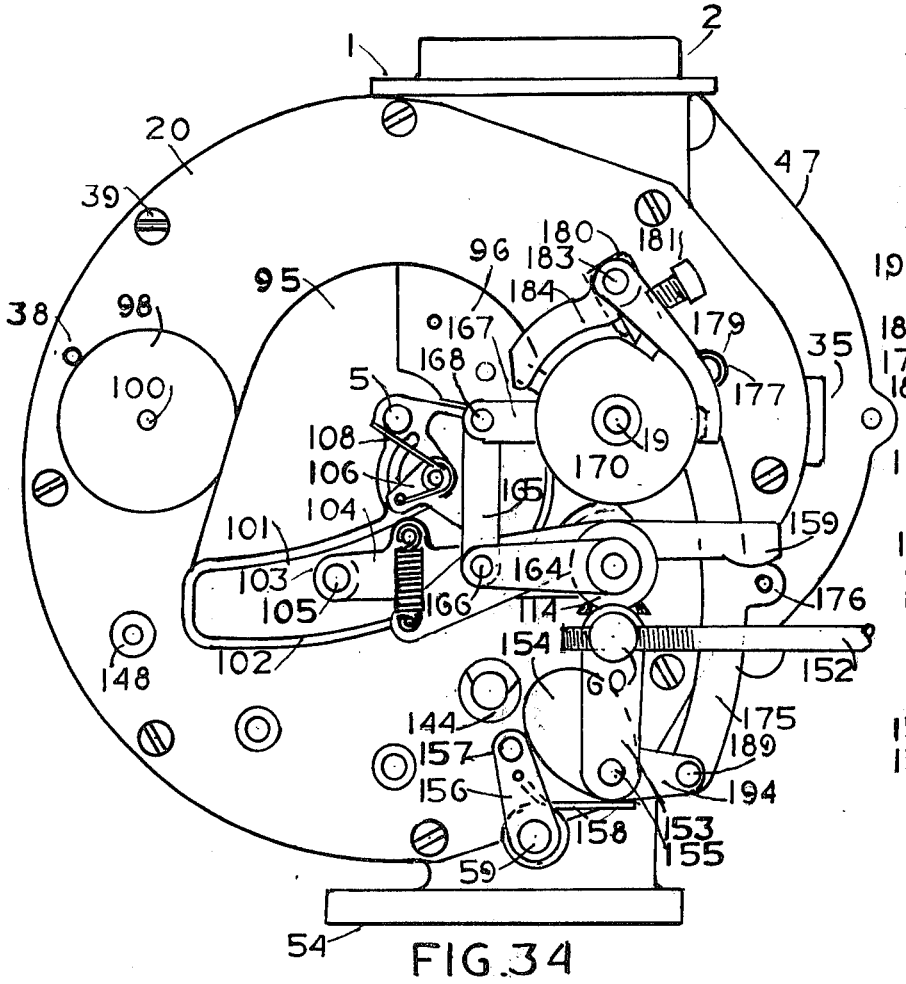
FIG. 34 is a front elevation of throttle control and pump control mechanism less compensators mounted on front cover.
Figure 41:
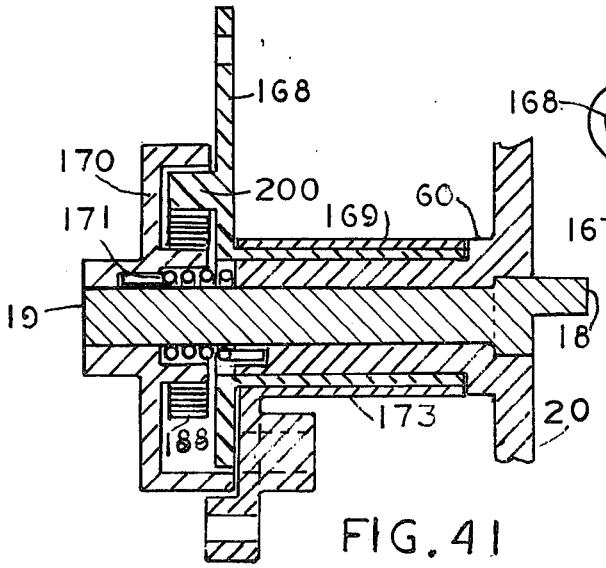
FIG. 41 is a sectional view of the assembly to the fuel pump control.

The pump adjusting shaft 19 FIG. 41 passes thru a boss 60 on front cover 20 and has fixed to its end a cup shaped element 170 FIG. 37, which is biased by spring 171 FIG. 41 to rotate in a clockwise direction as viewed in FIG. 34. Element 170 has a projecting lug 172 which forms a stop for its rotary motion by contacting and adusting screw 181 which passes thru the end of boss 180 projecting from front cover 20, FIG. 34. Element 170 is so located on shaft 19 that when contacting adjusting screw 181 in its mean position the pump piston 14 has no oscillating or pumping motion when rotor 12 is revolving which is the position it assumes when no air is passing from 2 to 54.

Figure 38A:
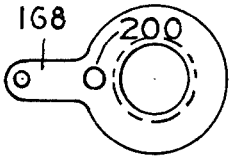
FIGS. 38 A and B shows front and side views of the fuel pump actuating arm and bearing.
Figure 38B:
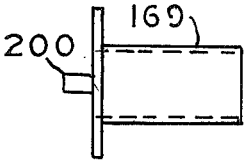

Inside cup shaped element 170 is a disc forming the flange of a tubular bearing 169 having an arm 168 FIG. 38 which is connected to link 165 by pivot 168 and hence to an arm 164 on differential gear 114 by means of pivot 166. This disc is supported by a tubular hub 169 FIG. 38 which uses outer surface of boss 60 as a journal and leaves it free to rotate about the axis of pump adjusting shaft 19. This arm passes thru a depression 201 on the rim of element 170, FIG. 37 which is of sufficient length so that arm 168 could go thru its full travel without contacting either end. Actually, however, both parts are biased by spring 188 so that when free to rotate and not confined, the arm 168 assumes a position against the end of the depression 201 in the rim of 170 adjacent to stop lug 172. Spring 188 is of sufficient strength so that it can readily overcome the effect of spring 171, and bring the two elements to this static position where the bias of spring 171 is transmitted back thru the linkage differential and finally restrained by roller 103 resting on cam surface 101 and slide 146 resting against pin 137 as will be described. This eliminates all backlash from the linkage. It should be noted that while elements 169 and 170 usually turn in unison with arm 168 resting against one end of the depression in the rim of 170, and held there by spring 188, nevertheless 170 can always, regardless of position of arm 167 be rotated back to the position where lug 172 rests against adjusting screw 181 and the pump discharge is at zero. In this manner the pump adjusting shaft 19 is linked thru disc 170, spring 188, element 169 and linkage 168 and 165 to arm 164 where it follows the combined motions of arm 104 and differential gear 113.

Figure 27:
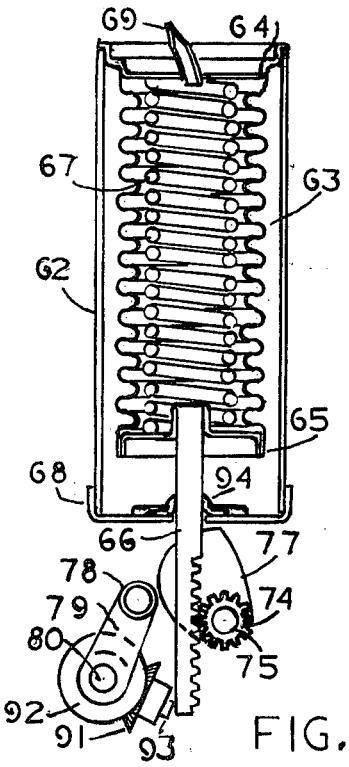
FIG. 27 is a section thru the air pressure sensing device with part of drive train.
Figure 30:
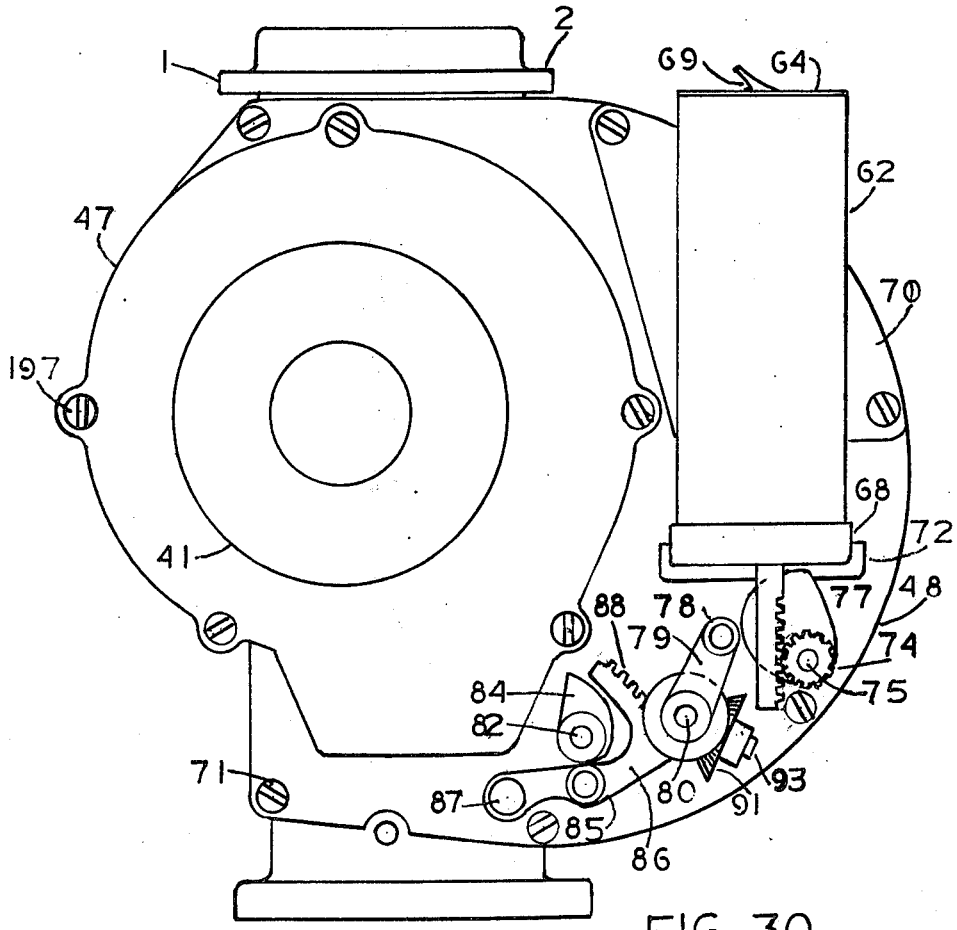
FIG. 30 is a rear view of carburetor complete showing motor, volute, humidity and air pressure sensors with drive trains.

The various means by which the air volume as measured by vane 4 is corrected for its principle variables: pressure, temperature and humidity, will now be described. On the rear view as shown in FIG. 30, are the mechanisms for compensating for air pressure and humidity. A dust cover (not shown), has been omitted that the mechanism will be clear. FIG. 27 is a cross section thru the barometric pressure sensing device. This consists of an outer shell 62 containing a flexible metallic bellows 63 closed at one end by a cover 64 fixed to and forming one end closure for outer case 62. The other end of bellows 63 is closed by cover 65 into which a round rod extension 66 is fixed. Within the bellows is a metallic spring 67. Rod extension 66 passes thru end cover 68 forming a closure for tube 62, and is sealed by a lip seal 94 preferably of Teflon. The cavity formed by bellows 63 and its two end covers 64 and 65 is evacuated thru tube 69 to a high vacuum, and then pinched and sealed. The atmospheric pressure against the resiliant bellows 63 is then supported entirely by spring 67, and variations of pressure within the tube 62 will cause the bellows to extend or partially collapse, imparting a linear motion to rod extension 66.

Figure 28:
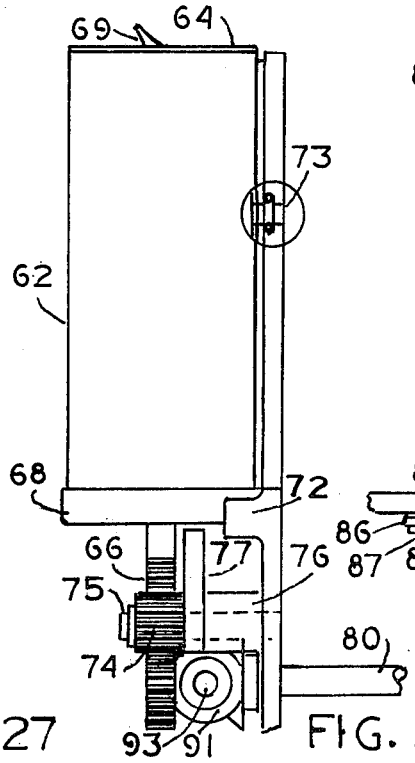
FIG. 28 is side exterior view of air pressure sensing device mounted on rear cover with part of drive train

As shown in FIGS. 28 and 30 this entire assembly is mounted on a flat plate 70 which is secured by two of the screws 71 fastening the rear end cover 48 to body 1. It is also more precisely located by a cradle 72 cast into end cover 48. There is an opening 73 connecting the inside of shell 62 with inside of rear cover 48 and sealed with an "O" ring. This passageway is formed by an opening in shell 62, plate 70 and rear cover 48 positioned to align on the same axis, and forming a continuous and air tight opening from the main body 1 to the barometric sensor. Thus the air pressure surrounding the bellows 63 is the same as in the body 1.

The rod 66 has gear teeth formed on its outer end, and these engage a small pinion 74 which is free to turn on a stud 75 fixed in a boss 76 forming part of rear cover 48 FIG. 28. This pinion 74 has a cam 77 attached to it which also turns on stud 75 and bears against roller 78 on the end of lever arm 79. This lever arm is attached to bevel gear 92 FIG. 29 which is free to turn on shaft 80 and meshes with differential gear 91 free to rotate on a stud 93 forming an extension of collar 202 fixed to shaft 80 FIG. 29 and rotating with it.

Figure 29:
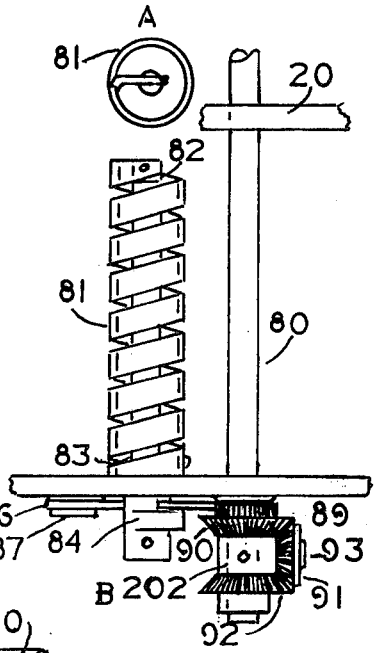
FIG. 29 is humidity sensing device with drive train.

Humidity is sensed by a helical wound element 81, FIG. 29 fixed at one end to a boss 83 protruding from inside of rear cover 48, and attached at its opposite end to a rod 82 forming its axis and passing thru boss 83 which acts as its bearing and in which it is free to rotate. This helix is fabricated of an outer layer of nylon bonded to an inner layer of acetal or some other suitable material. The nylon is embossed in a honeycomb pattern with as thin partitions as possible to give it maximum exposure of area. As is well known, Nylon is a hydroscopic material, absorbing and losing water readily to the atmosphere as the humidity rises and falls, and it expands and contracts with this gain or loss of moisture. Acetal on the other hand is very stable to variations of ambient humidity. The increase in length of the Nylon with an increase of humidity, and vice versa, will cause the coil 81 to rotate slightly and rotate shaft 82 attached to it around its axis. Nylon and Acetal have very nearly the same rates of temperature expansion, and can be made identical in this respect by the addition of powdered glass beads to the one or the other. The movement of helix 81 can, therefore, be made independent of temperature variations, yet responding to changes of humidity.

On the outside of cover 48, FIG. 30, shaft 82 has a cam 84 fixed to it, and this cam engages a roller 85 fixed on a lever arm 86 which is pivoted on a shoulder stud 87 fixed to rear cover 48. At its opposite end arm 86 terminates in a gear segment 88 which is formed on a radius from pivot 87. This gear segment meshes with a pinion 89 FIG. 29 formed integral with bevel gear 90, both of which are mounted on shaft 80, and free to turn about it as an axis. Meshing with bevel gear 90 is another bevel gear 91 which as stated above is mounted on a stud 93 attached to boss 202 and rotating with it around shaft 80.

The bevel gears 90, 91, 92 FIGS. 29 and 30 form it will be noted a well known differential mechanism whereby the motion of lever arm 79 and movement of arm 86 are combined into rotary motion on shaft 80. In both cases this motion is imparted thru cams as neither the motion of bellows 63 or helix 81 would be strictly a straight line function in response to barometric or humidity changes. In both cases this can be corrected in the cam contour as would be evident to anyone skilled in the art. Also, by properly sizing the bellows and helix as well as the cams and gearing, the two sensing devices can be designed each to impart to shaft 80 the precise amount of radial motion to correct the mixture for the conditions to which they respond, thru mechanism now to be described.

Shaft 80 has thru the structure described become the means of transferring motion to modulate the fuel supply and thus to compensate for the effects of barometric pressure and humidity in maintaining an accurate air/fuel ratio. It is now necessary to combine this motion with a temperature correction and connect it to the metering pump in such a manner that it will modulate the output of that component by the proper percentage regardless of flow rate.

In FIG. 29, the shaft 80 passes from the rear cover cover 48 where it has registered the compensations for humidity and barometric pressure thru the front cover 20 and terminates in a differential mechanism composed of gears 118, 121 and 122. FIGS. 31 and 32. Bevel gear 122 is fixed to shaft 80. Gear 121 is mounted on a stud projection of hub 120 on which it is free to rotate as hub 120 is free to turn on shaft 80. Except where gear 121 is mounted on hub 120, this hub is circular, and provided with gear teeth which mesh with a gear segment 128 forming part of arm 129 which is pivoted around shoulder stud 130.

Figure 10A:
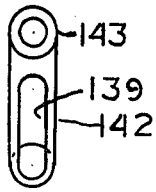
FIGS. 10 A, B, and C are three views of the compensating proportioning arm.
Figure 10B:
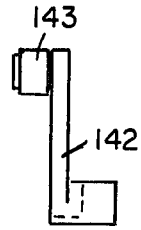
Figure 10C:
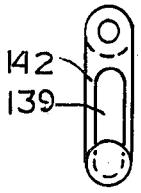

The third gear of the differential 118 FIGS. 8, 31 and 32 is free to turn on shaft 80 and has a spur gear 119 fixed to its hub which engages with gear segment 131 FIG. 8 forming part of lever arm 126 which is pivoted on shoulder screw 133. Mounted on this lever is a roller 127 which engages a cam 125, and is responsive to its motion. This cam is mounted on a shaft 124 which forms the axis and is secured at its inner end to bimetal helix 123, FIG. 32, which is mounted at its opposite end on boss 117 forming part of front cover 20. This helix is similar to those widely available for controlling and compensating temperature and is similar to helix 81 FIG. 29 except for the materials used to form the laminate. Where intended for temperature response, these materials are usually invar having a very low rate of expansion, and a chrome steel alloy with a high rate of expansion. As helix 123 turns in response to temperature variations, it gives angular motion to shaft 124 and cam 125. This motion in turn moves lever 126 and the gear segment on this lever rotates spur gears 119, and hence bevel gear 118, FIGS. 8 and 32. Since bevel gear 122 is fixed to shaft 80 gear 118 tends to rotate hub 120 thru bevel gear 121 as does any motion of gear 122 registering changes of air pressure or humidity. All of these changes are, therefore, combined into motion on hub 120 which in turn transmits it to lever arm 129 thru gear segment 128 tending to rotate it around pivot 130. There is a coil torsion spring 138 around the support hub for lever arm 129, one end of which is attached to front cover 20 and the other to a link 136, FIG. 31 pivoted on the extremity of arm 129 by shoulder stud 134. This spring tends to rotate arm 129 in a clockwise direction as view in FIG. 31, and hub 120 and differential gears 118, 121 and 122 in a counter clockwise direction which is fed back on shaft 80 to the barometric and humidity compensators. This bias keeps all rollers engaged with their cams, and eliminates backlash from the entire drive train. It should be understood that the effect of each compensator in turning gear segment 128 should reflect its precise requirement to alter the air volume/fuel ratio to maintain a constant oxygen/fuel ratio. This effect can be achieved with great accuracy by the cam contours, lever ratio, gear ratios etc. which will be evident to anyone skilled in the art. This motion of lever arm 129 is now combined with the motion of arm 104 as a percentage of the latter's motion in the following manner:

Arm 104, FIGS. 8, 9 and 31, has a skirt 140 formed integral, and so shaped to clear differential gears 113, and 114. This skirt carries a cam 141 which contacts a roller 143 on a lever arm 142, FIGS. 8 and 10. This arm has a hub on its opposite end and opposite side from roller 143, and has a central slot 139 extending from near the roller at one end to beyond the axis of the hub at the other. The hub of arm 142 fits into a socket 144, FIG. 34 in front cover 20 in which it is free to rotate actuated by cam 141 acting on roller 143.

Pivoted in the end of arm 129 is a link 136 which has a pin 137 in its opposite end, FIG. 31. This pin has a slight shoulder near its center and is pressed into link 136 and welded. When assembled, link 136 rests directly on arm 142 with one end of pin 137 sliding in slot 139 and moving in an arc around pivot 145 as lever arm 142 moves in response to motion of cam 141.

Directly above link 136 is slide 146. FIG. 31, which has an elongated opening 150 on each end by which it is located by shoulder screws 147 to bosses 148 on front cover 56. It is free to slide with a reciprocating motion to the limits of its elongated openings.

Slide 146 has gear teeth 149 forming a rack which engages gear 115, and thru which it transfers its motion to the differential composed of gears 112, 113, and 114, FIG. 32. Slide 146 also has an elongated opening 260 which runs transversely across its face and whose axis aligns exactly with the axis of the slot in arm 142 when that arm is resting against its cam in the zero or rest position. The extension of pin 137 in link 136 extends thru this slot 260 and as arm 142 moves in response to cam 141 and pin 137 moves with it, slide 146 also moves, transferring its motion as noted above.

It will be seen that as arm 129 moves in response to the compensating sensors, link 136 will move pin 137 radially in arm 142 from a position where it is aligned with its axis to a maximum, and that as arm 142 is rotated by cam 141 pin 137 will move slide 146 by infinite variations from zero to the predetermined maximum. This range is designed to be adequate to provide compensation for any atmospheric condition which could be encountered. It should also be noted that the degree of compensation is in a precise percentage at all rates of fuel consumption and that the total motion provided by cam 95, and the compensating cams are now combined on differential gear 114. As mentioned above, differential gear 113 is biased by a spring which reacts to move slide 146 to its minimum effective position which in turn keeps roller 103 against cam 101, and otherwise eliminates all backlash from the linkage.

In FIGS. 33, 34, 35, 36 and 43 the accelerator pedal is connected to the throttle valve and controls the volume and richness of air-fuel mixture in the following manner:

The accelerator rod 152 is pivotally connected to arm 153 which in turn pivots about stud 155 rigidly affixed to front cover 20. Fixed to the hub of arm 153 is a cam 154 which contacts a roller 157 carried by an arm 156. This arm is fixed to and pivots on shaft 59 to which throttle valve 55 is attached. The throttle valve is biased to a closed position by spring 158 which keeps roller 151 in contact with cam 154. Accelerator rod 152 is likewise spring biased to turn arm 153 in a clockwise direction and permit the throttle valve to close whenever pressure is removed from accelerator pedal.

Figure 39A:
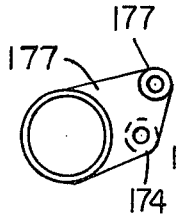
FIGS. 39 A and B are front and side views of the accelerator positioning arm on the pump control.
Figure 39B:
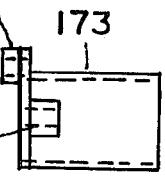

The hub of arm 153 also has another arm 194 which carries one end of curved link 175 by a pivot 189. The other end of this link 175 is supported in a pivot 174 attached to disc 173, FIG. 39. Link 175 also carries a pin 176 in closed juxtaposition to a curved segment of arm 159 which can revolve around a pivot 160, FIG. 44 but is restrained by a spring 161, one end of which is attached to a stud 162 in end of the arm 159 and the other to a stud 163 in arm 104. This spring causes arm 159 to rest on the hub of arm 104, but if sufficient pressure is applied to curved segment on opposite end as by pin 176, it will overcome the natural bias of arm 104 to a clockwise rotation, and cause roller 103 to leave surface 101. If the pressure is sufficient, roller 103 will eventually reach surface 102 which limits its further motion. Lever arm 159, however, can continue to move around its pivot 160 by extending spring 161.

While the arm 153 travels thru a maximum of 90 degrees and arm 159 thru 45, the radius of its movement is roughly double that of arm 153, and therefore their total movement is approximately equal. In operation, as the accelerator rod is moved and arm 153 rotates, cam 154, there is first a short dwell on the cam and with no movement of the throttle valve. Pin 176 approaches arm 159 and almost contacts. Then as the throttle valve opens under influence of cam 154, the increase of air flow moves vane 4 and main cam 95. This causes arm 104 with arm 159 to rotate about their pivot 111 with the result that by the shape of cam 154 and the length of arms 153 and 159 the device can be designed so that with a normal cruising or accelerating load on the engine pin 176 does not contact arm 159, but should the load increase and the engine speed become slower for a given accelerator position, the pin 176 will contact arm 159 and rotate it about its pivot with arm 104. This causes roller 103 to leave cam surface 101 and approach cam surface 102, which it will eventually if the pressure is continued. In the meantime link 165 has transferred the motion to the pump and increased the richness of the mixture.

Figure 42:
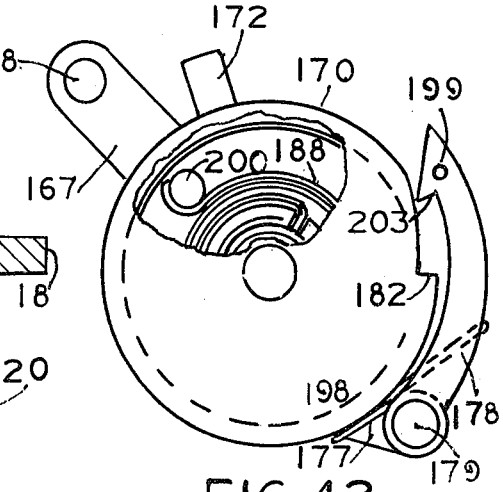
FIG. 42 is a front elevation with partial section of the fuel pump control.

It is desirable that when decelerating or coasting down grade that the fuel supply be sharply decreased or curtailed entirely above a fixed minimum speed close to idling. This is done in the following manner:

Pump drive disc 170 has on its periphery a step 182 and the arm 177 carries a pawl 203 which is biased by a spring 178 to move in contact with the outer surface of 170. This pawl has a projection 199 FIG. 42 near its end opposite its pivot. The pawl 178 is so located in relation to the step 182 that when they are latched and the accelerator is at rest, the stop 172 is against its adjusting screw 181. In normal driving the step 203 in pawl 178 is in advance of step 182 in disc 170, but if accelerator pressure is relieved the pawl latches and rotates 170 back against its stop in zero pumping position.

Figure 40A:
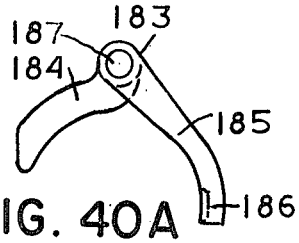
FIGS. 40 A, B, and C shows three views of the rocker release arm for coasting fuel shut-off.
Figure 40B:
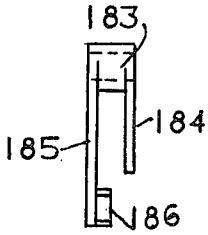
Figure 40C:
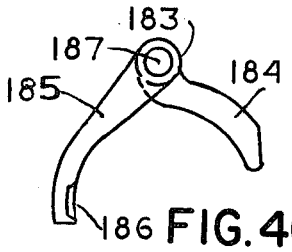

The support boss 180 has pivoted to it at its outer extremity a rocker 183 FIG. 40 with two curved arms 184 and 185 in different planes, the latter of which has a projection 186 which rests on the periphery of disc 170, under the influence of spring 195 and the other arm 184 is concentric with disc 170 on the opposite side with a slight clearance. When the pawl 178 is latched to disc 170 and there is no pressure on the accelerator the pump output is at zero and the projection 199 on pawl 178 is just over projection 186 on rocker arm 185. With the fuel supply stopped, the vehicle will slow down, and arm 168 moves about pivot 19 until its extension 168, FIG. 33, strikes the cam arm 184 and depresses it toward disc 170. This motion causes projection 186 to strike pin 199 in pawl 178 and lift it out of engagement with catch 182 in disc 170, which under the influence of spring 171 rotates back to its engagement with 168. This restores the flow of fuel to its proper ratio. At just what engine speed this unlatching occurs can be controlled by the length of cam arm 184. Thus when the pressure is removed from the accelerator as in deceleration or coasting down hill, the fuel supply is shut off until the engine speed decreases to a predetermined point, which is generally considered one of the more important points in reducing pollution and saving fuel.

It is generally acknowledged that stratified charge internal combustion engines offer some unique advantages in decreasing pollution and increasing gas mileage. Stratified charge engines require two separate fuel air ratios, one which is ideal for ignition and is admitted in relatively small quantities in the proximity of the spark plug, and another which is relatively lean and forms the main charge. Up to the present time it has been customary to provide two separate carburetors to perform these functions or to build what is essentially two carburetors into the same body. Two separate fuel-/air ratios can be provided by the carburetor here presented with only a slight modification which will now be described.

Figure 3:
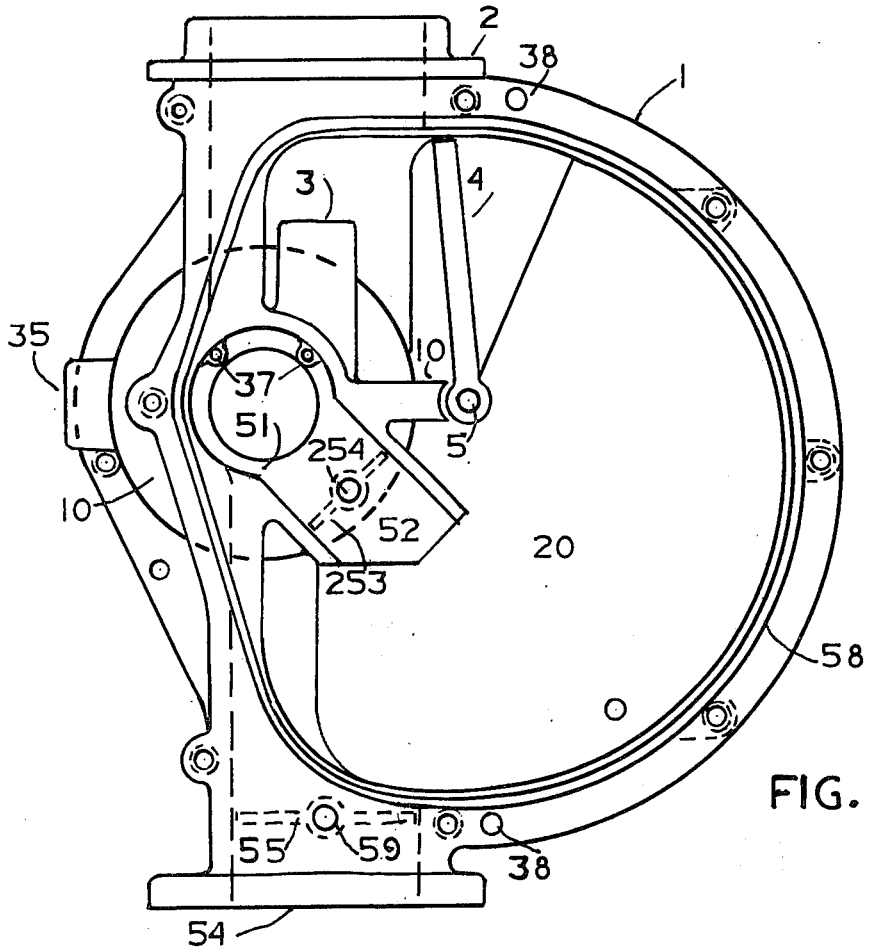
FIG. 3 is a rear view with rear cover removed to show air measuring vane and blower air circulating duct.
Figure 4:
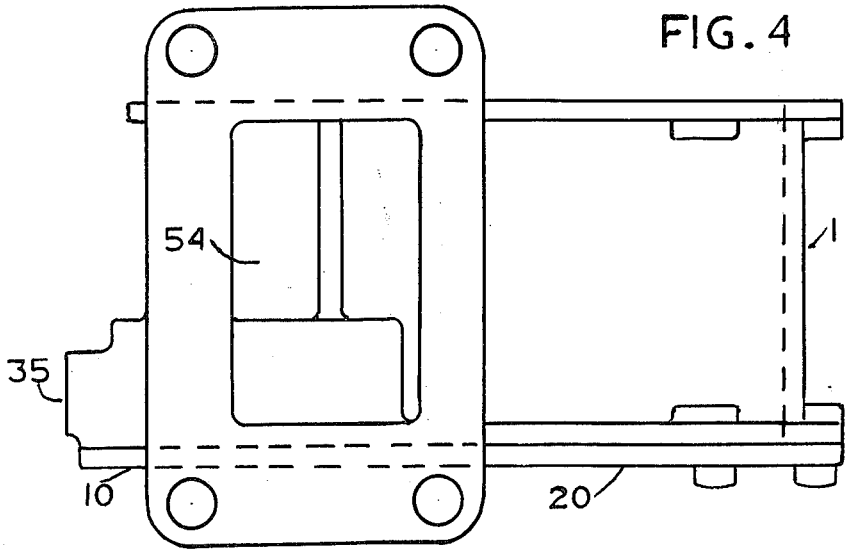
FIG. 4 is a bottom view with rear cover removed showing air-fuel mixture discharge to intake manifold, less throttle valve.
Figure 45:
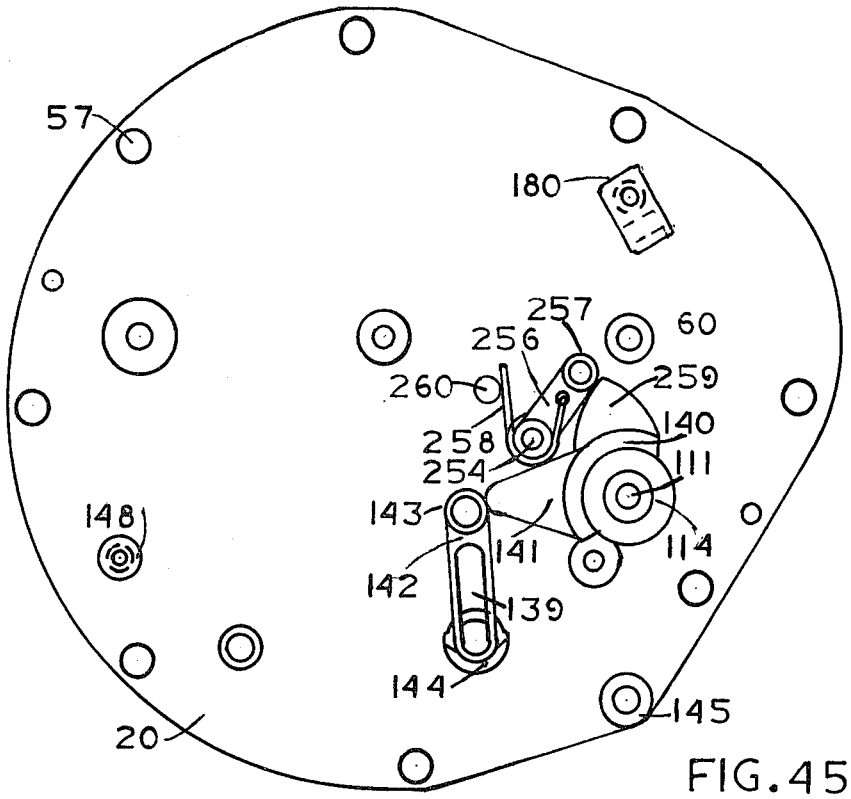
FIG. 45 shows throttle operating mechanism for control of the high ratio on a dual ratio delivery system.
Figure 46:
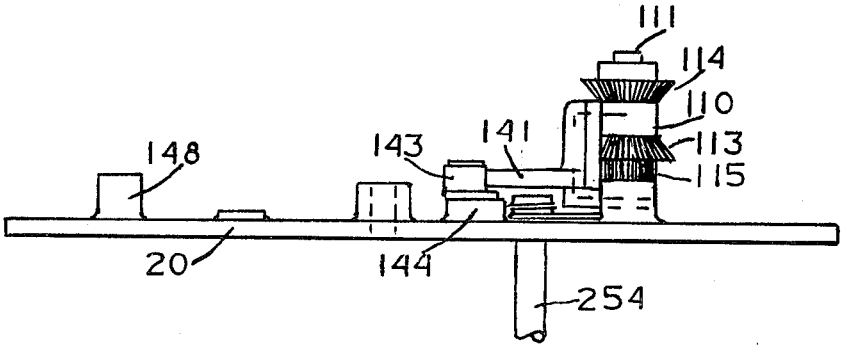
FIG. 46 is a bottom view of the control mechanism in FIG. 45.

In FIG. 3 a butterfly type of throttle valve 253 is shown in dotted outline in passageway 52 which provides part of the conduit for air entering the blower wheel 46. This valve is pivoted on a shaft 254 which has one bearing in the rear cover 48 and another 255 in the main body 1 adjacent to the metering pump cavity 10. This shaft passes thru a clearance opening in front cover 20 where it terminates in a lever arm 256 FIGS. 45 and 46. At the extremity of arm 256 is a roller 257 which rides on a cam 259 formed integral with skirt 140 on a plane between cam 141 and front cover 20. Roller 257 is kept in contact with cam 259 by a spring 258 one end of which engages arm 256, and the other a projection 260 on cover 20.

It will be seen that as cam 104 moves following the cam 95 which monitors the volume of air, the cams 141 and 259 move with it and the latter controls the air volume entering blower wheel 46 by means of valve 253. Since arm 104 also controls the volume of fuel entering blower wheel 46 subject only to ambient corrections, cam 259 can be so contoured that a precise and constant air-fuel ratio can be maintained in volute 47 subject only to ambient corrections. This mixture will not change with enrichment of the main charge for torque, which can run from very lean to any desired consistancy.

Figure 25:
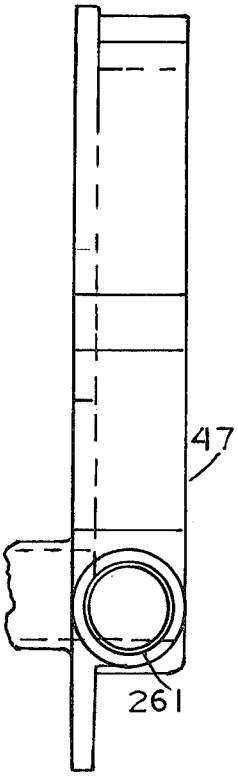
FIG. 25 is an edge view of rear cover with optional rich mixture discharge for stratified charge engines.
Figure 26:
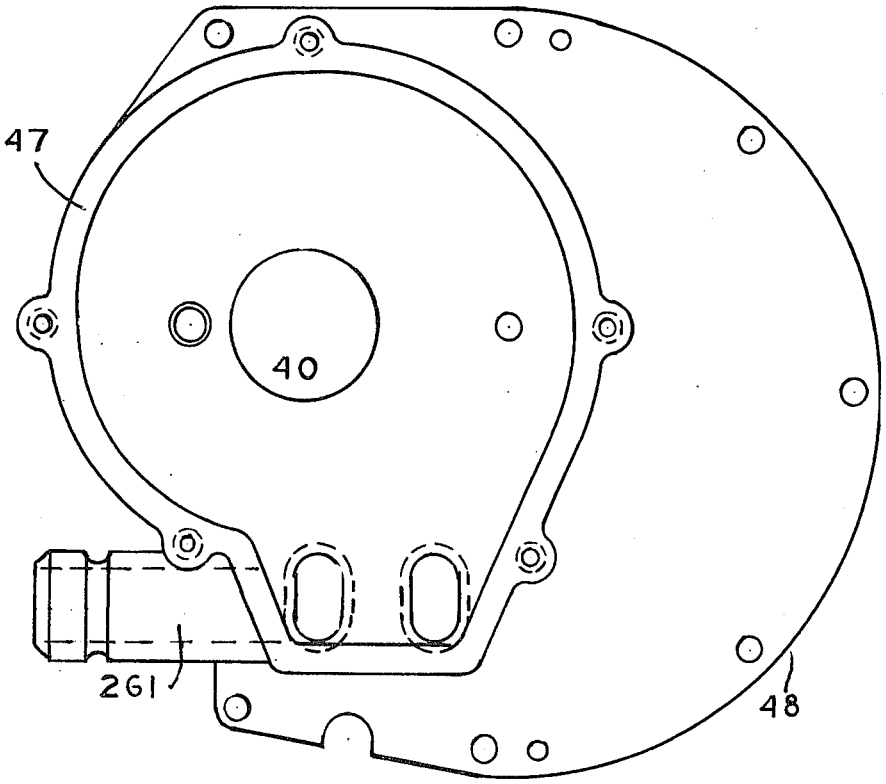
FIG. 26 is an elevation of rear cover showing volute, inlet to main charge discharge tubes, and optional high ratio discharge for stratified charge engines.

In order to conduct the rich mixture as produced above to the combustion area adjacent to the spark plugs a conduit connection 261 FIGS. 25 and 26 is added to the base of the volute 47 from which the mixture is conducted to a suitable manifold conveying it to the various ignition areas. The balance of the rich mixture passes thru tubes 117 and is discharged from their openings 132. Here it is mixed with more air entering discharge 54 to become a lean mixture, the exact ratio of which is predetermined by the fuel pump volume controlled by arm 104. Thus it will be seen that a precise and uniform rich mixture can be provided for ignition which is corrected for ambient conditions and simultaneously a lean mixture also corrected for ambient conditions and also subject to prompt enrichment if torque requirements make this desirable.

Figure 43:
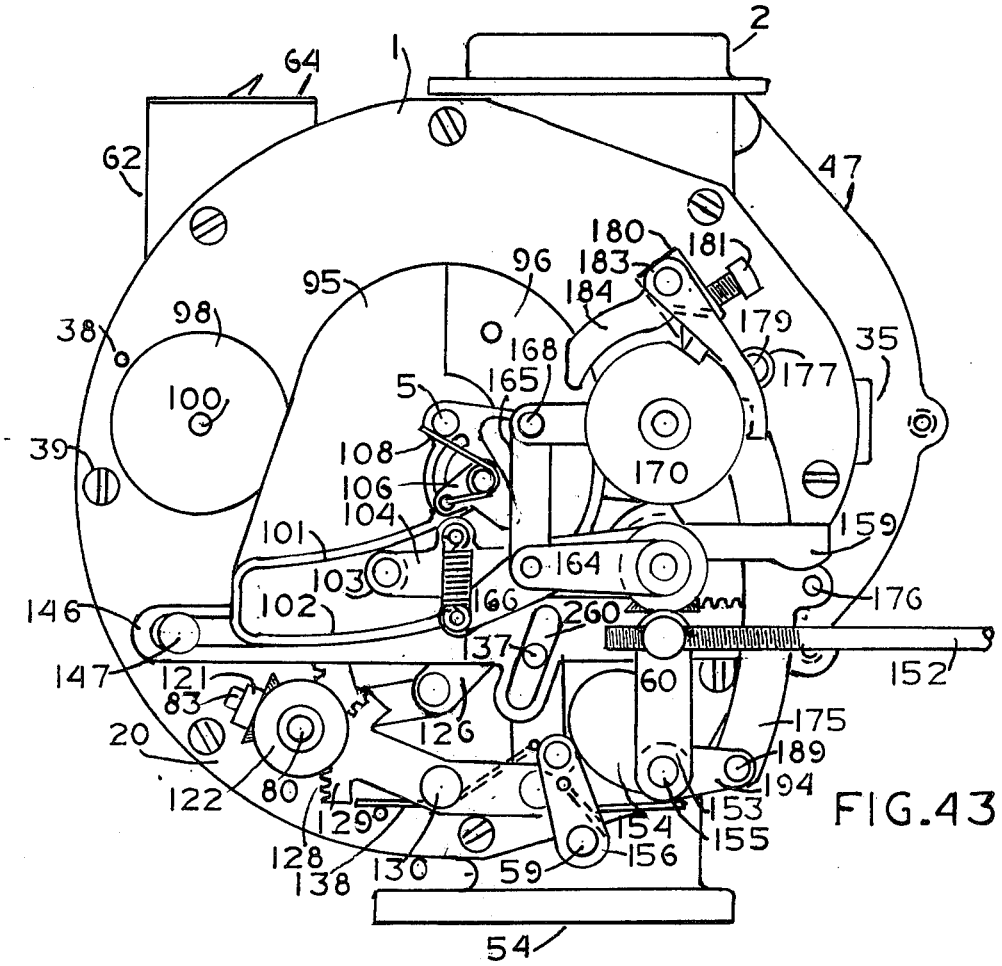
FIG. 43 is a front elevation of carburetor with complete mechanical control mechanism.

FIG. 43 shows a front elevation of carburetor with mechanical operation, and all parts in place. The cam 95 is in approximately the position it would assume on normal cruising and the roller 103 is against cam surface 101 indicating a lean mixture and light or normal engine load.

Figure 44:
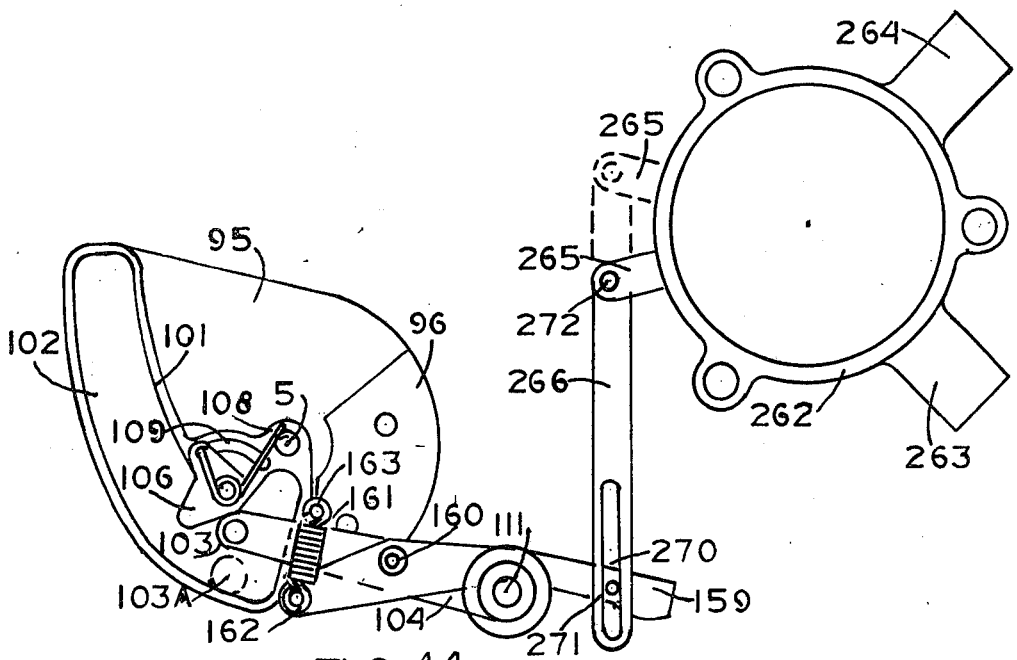
FIG. 44 shows the control mechanism for a cold starting enrichment.

On carburetors of the venturi-float chamber type it is mandatory to sharply increase fuel supply during a cold start. This is because cold fuel at cranking speeds does not vaporize readily and large drops lodge on the inside of the intake manifold until it becomes heated. This condition is largely overcome in the carburetor described above because of the thorough atomization regardless of engine speed the fuel receives in the blower wheel and to some degree because of the cold compensation also described above. However if desired further cold starting enrichment it can be done as shown in FIG. 44. 262 is a thermostat as commonly used to operate the automatic choke on most current carburetors. These consist of a closed housing for a bimetal thermostatic element, one end of which is fixed to the housing and the other to a shaft or arm which operates the choke. This housing has an inlet and outlet conduit thru which air is drawn from a heat transfer surface in the exhaust manifold to a point of some suction in the air intake system. In FIG. 44, 263 is a hollow boss for connection to the heat transfer surface commonly done with a flexible tube, and 264 a similar hollow boss for connections to the air intake. Arm 265 is connected to one end of the bimetallic element, and on a cold start would be in the position of the dotted outline and after the engine is warm would assume the position shown in solid outline. Connected to arm 265 by a pivot 272 is a link 266 having at its lower extremity a slot 270. This slot incloses a pin 271 in arm 159 previously described. When the engine is started cold arm 265 tries to assume the cold position shown in dotted outline, and in doing this pin 271 strikes the bottom of slot 270 which causes arm 104 to rotate about its pivot and roller 103 to assume the position 103A. Thus when starting the mixture is enriched as described above. As the engine warms up, arm 265 returns to the position shown in solid outline moving link 266 to a point where the bottom of slot 270 no longer contacts pin 271 which is free to move in the slot. The air/fuel ratio is controlled entirely by cam 95 and the various compensators.

Hydraulic actuation of the compensating functions is possible and permits remote sensing of engine operating conditions. Such a system is shown diagramatically in FIG. 47. It consists essentially of a liquid tight combination of fixed and variable volume cavities connected by capillary or small diameter tubing and completely filled with a suitable liquid. The total output of all sensing elements is integrated, and terminates in variable volume cavity 233, which responds with a change in length to a change in length of other variable volume cavities and also to increases and decreases of total system liquid volume due to thermal expansion or contraction of the liquid in the fixed volume cavities.

Starting at the upper right, 203 is a fixed volume bulb which replaces the bimetallic air temperature sensor 123. 204 is a conduit for the fluid moving in or out of bulb 203 with changes of temperature. This conduit joins other similar conduit in cross over 221. The element A replaces the humidity compensator 81. It consists of a thin tube of nylon 205 resting on a metallic bellows 206 which is completely closed except for tube 211 leading to tee 220. The Nylon tube 205 is positioned at one end by a cover 208 supported by two or more acetal rods 209 having the same rate of thermal expansion as Nylon cylinder 205, and at the opposite end secured to the bellows end cover so the two must move along their axis in unison. These rods are secured at their opposite end in a flange mounting plate 207, thru which the tube 205 is free to move. The bellows 206 is likewise secured to plate 207 at its outer end by a cup shaped element 210, shown partly in section. Then as the tube 205 expands and contracts from changes of humidity it carries one end of bellows 206 with it, changing its internal volume and forcing liquid in or out of tube 211.

The element B replaces the barometric compensator 62 above described except that the bellows 63 is replaced by a bellows 212 of identical construction which is connected to another bellows 214 by a link 215. Bellows 214 is part of a closed hydraulic system and is connected to it by tube 217. As bellows 212 expands and contracts along its axis in response to variations of atmospheric pressure, it carries the end of bellows 214 with it, changing its internal volume and forcing liquid into or out of its cavity thru tube 217.

One of the advantages of hydraulic sensors is that they can be conveniently installed remotely. 218 is a fixed capacity bulb with sufficient tube 219 to be installed in a suitable part of the liquid cooling system of the vehicle engine. Here it will sense the engine temperature and the fluid contained in the bulb will diminish in volume with a falling temperature and increase with a rising temperature. This bulb replaces the bimetallic cold start thermostat 262 FIG. 44.

There have been a number of transmissions suggested for automotive vehicles which operate on hydraulic pressure, said pressure precisely indicating the torque load on the engine. One of these is disclosed in De Lancey U.S. Pat. No. 3,845,623, shown diagramatically at the bottom of FIG. 47. 243 is the input shaft connected to the engine, and 244 the out-put shaft connected by other members of the drive train to the rear wheels. 245 is a positive displacement hydraulic pump. Input shaft 243 is connected to the rotor of this pump and 244 to the pump housing. Both shafts are on the same axis, and the exterior of the pump casing is concentric with this axis and has the pump inlet and outlet ports on this exterior surface and aligning themselves with suitable conduits in a stationary housing 246. The outlet to the discharge conduits in 246 is controlled by valves modulated by the speed of shaft 243 in such a manner that there is little pressure at engine idle speed and therefore little tendency to lock the pump and transmit torque to shaft 244, but above idle speed the pressure is determined by the resistance of shaft 244 up to a point slightly under engine maximum torque for any given speed. The valves then open relieving the pressure and stabilizing the torque on 243. It will be seen, therefore, that the discharge pressure of pump 245 has a precise relationship to the torque on shaft 243. This pressure is transferred thru tubing 247 to two elements C and D which will now be described. Element C has a bellows 223 which is liquid tight and receives pressure internally from conduit 247. This bellows at one end is mounted on a base 224, and at the other is closed and fixed to a cup shaped element 226 which is flanged at its lower edge to engage one end of spring 225. The other end of spring 225 contacts a partition 229 which is rigidly connected to base 224 by cylinder 227 and so spaced that there is considerable pressure exerted by spring 225 on member 226 constraining movement of bellows 223. Mounted on the opposite side of partition 229 is a bellows 228 forming part of the hydraulic sensing system and connected to it by conduit 222 and suitable porting in base 229 to the interior of said bellows. Bellows 228 has fixed to its opposite end a plate 230 which is connected by two or more rods 231 passing thru clearance holes in partition 229 to be fixed to the top edge of cup 226 to become a part of its movement. Thus it will be seen that as pressure is admitted by tube 247 into bellows 223 it will eventually overcome the pressure exerted by spring 225, lifting cup 226 and thru the rods 231 and plate 230 will extend bellows 231 along its axis and lowering the liquid pressure in conduit 222.

The various sensors terminate in the element D which consists of a bellows 233 to which conduit 222 communicates internally thru base 234 and having a casing 235 thru which extends on one end the link 236 pivotally mounted on the free end of the bellows. It will be seen that as the volume of fluid in elements 203, 206, 214, 218 and 228 changes under various conditions, some expanding in volume and some contracting, the net increase or decrease will determine the length of 233 on its axis and therefore the position of link 236. Moreover the size of each cavity can be so determined that it will impart to link 236 the proper amount of motion to correct the air/fuel ratio for its particular condition in the manner to be described. It should also be noted that bellows 233 has atmospheric pressure against its free end which biases it in the contracted position with considerable force and that the sensors are designed to apply considerable pressure to the hydraulic fluid with the result that adequate energy is available at link 236.

Figure 47:
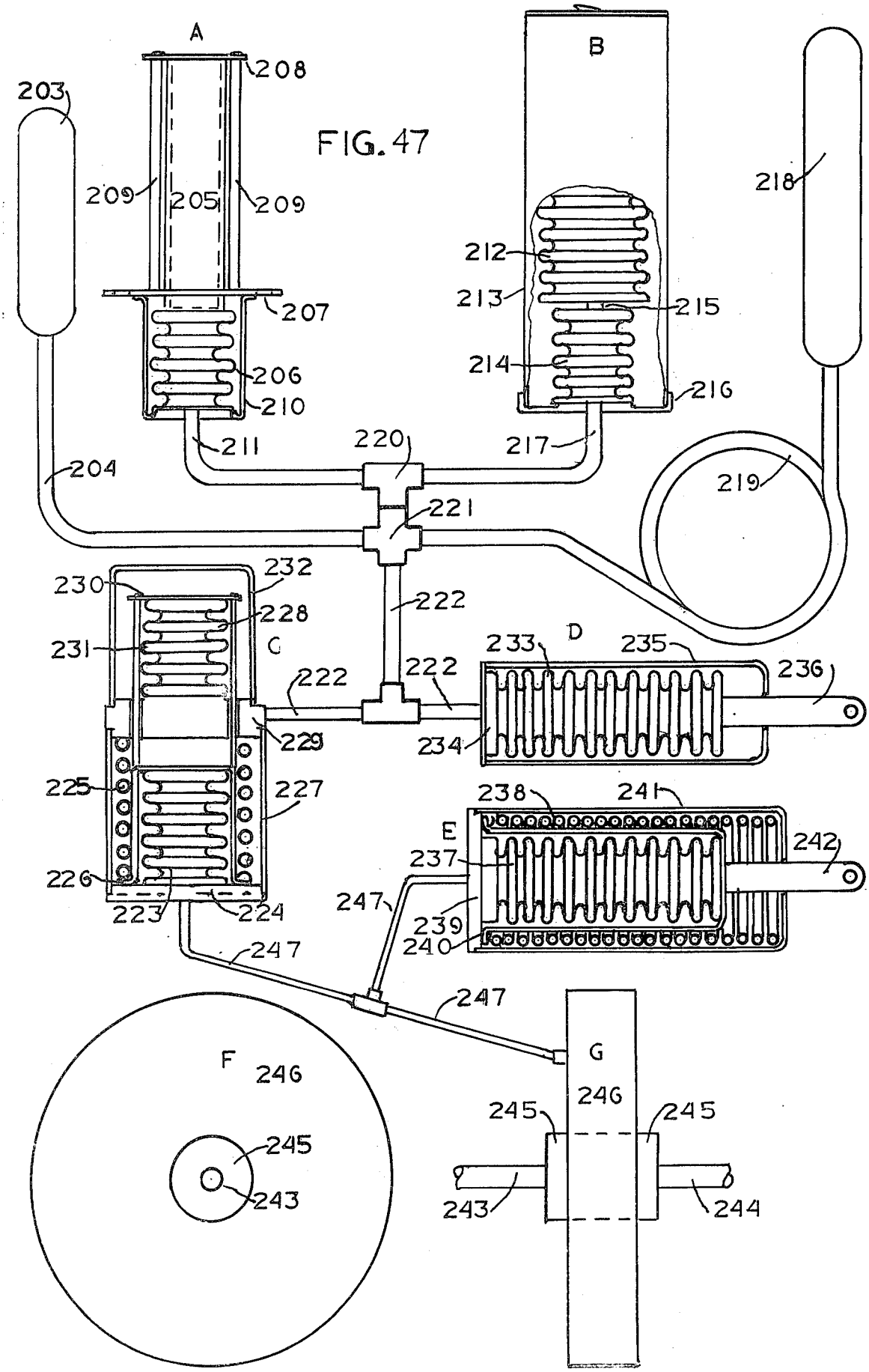
FIG. 47 is a diagramatic view of a hydraulic control system for carburetor ratio compensation.

FIG. 47 also shows an element E which consist of a bellows 237 mounted on a base 239 to which conduit 247 sensing engine torque is connected internally. This bellows has a cup shaped element 240 surrounding it, one end of which is flanged to support a spring 238. The entire assembly is inclosed in a shell 241 which constrains the other end of the spring and thru which a link 242 passes which is pivotally attached to cup 240 and follows its movement. Spring 238 is considerably weaker than spring 225 and even pressures resulting from moderate torques will expand bellows 237 to the limit of its movement.

FIGS. 48 and 49 are rear and front views of the carburetor showing how this hydraulic actuating system is mounted on the carburetor to perform its various functions. FIG. 48 is a view of the rear cover with the barometric compensator 248 in place and connected to humidity compensator 249 and engine temperature compensator 218. These are connected by capillary tubes 250, 251 and 219 to a tee 252 from which runs a branch conveying hydraulic fluid to and from the other elements mounted on the front cover.

FIG. 49 is a front elevation of the carburetor with all control mechanism in place. The accelerator rod 152 now operates the throttle valve 55 direct thru crank 156 and pivot 59. The torque compensator 227 is mounted near the top. It receives pressure from the transmission thru tubing 247, and connects its compensating liquid thru tube 222 which combines with liquid from elements on rear cover in tube 252 to operate actuator 235 with its link 236. This link is connected to link 136, FIG. 31, by a bell crank 273 revolving about a pivot 274. As 236 moves, therefore, the pin 137 moves also and establishes the percentage of compensation in the air fuel ratio for the conditions monitored.

The element 241 is mounted as in FIG. 49 and connected to the torque pressure conduit 247. The end of link 242 is connected to element 173 FIGS. 39 and 41 to a boss similar to 174 located on a proper radius. As stated above the link 242 becomes fully extended even at pressure generated by moderated torques. Thus element 173 with catch 178 are rotated to the limit of their travel, and upon a sufficient reduction of the torque pressure as would occur in decelerating or going down grade link 242 would rotate 173, catch 178 and thru stop 182, bringing 170 back to zero pumping position until catch 178 is disengaged by rocker arm 185 as described above. This would occur when pin 168 strikes arm 184, slightly above idle speed at closed throttle.

While two embodiments of the invention have been illustrated and described in considerable detail, the invention is not to be considered limited to the precise constructions shown. Various adaptations, modifications and uses of the invention may occur to those skilled in the art to which it relates and the intention is to cover all such adaptations, modifications and used of the invention which come within the spirit or scope of the appended claims.

What we claim is:

1. A carburetor for supplying a continuous mixture of air and finely divided fuel particles to an internal combustion engine having a fuel volume control comprising:

(a) a main body having an air inlet and a mixture outlet, a closed conduit connecting said inlet and outlet, and a valve in said outlet controlled by linkage to the engine's fuel volume control;

(b) a shaft, one end of which extends to the exterior of said body enclosure, a vane in said conduit fixed to and rotatable on said shaft, the position of said vane defining the size of a variable orifice in said conduit, and a spring biasing said vane against the direction of air movement to a minimum orifice size but responsive to increasing air volume to enlarge said orifice area approximately in proportion to the air volume passing from said inlet to said outlet;

(c) a variable capacity rotary metering pump for measuring fuel volume, a constant speed electric motor driving said pump, said pump housed in said main body enclosure and having its inlet connected to a pressurized fuel supply, and its discharge mixing with the metered air, and a modulating shaft for modulating the output of said pump, said modulating shaft extending to the exterior of said body enclosure;

(d) a mechanical linkage connected between said vane and said modulating shaft whereby said vane supplies the energy and movement to position said modulating shaft and maintain the air-fuel ratio within predetermined limits regardless of air volume.

2. A carburetor as claimed in claim 1 in which the linkage between the axis of the vane measuring air volume and the shaft controlling metering pump volume includes internal and external cam surfaces rigidly mounted exterior of the body on the vane axis and having a roller capable of contacting both said cams mounted at the end of an arm pivoted on the body at the opposite end, said cam surfaces defining respectively the minimum and maximum movement the arm can attain for each variable orifice size and thereby controlling the limits of the air/fuel ratio.

3. A carburetor as claimed in claim 2 in which the arm carrying the roller contacting the cam surfaces is biased by a spring to normally contact the cam imparting the minimum amount of movement to the arm.

4. A carburetor as claimed in claim 3 in which the arm carrying the roller is connected to the throttle control linkage actuated by the accelerator pedal, said arm having a linear extension beyond its pivot and said extension having a pivot of its own on said arm with a spring tending to rotate it around said pivot, but confined by the arm pivot acting as a stop, and an abutment on the accelerator linkage which contacts this extension under heavy load conditions when the fuel volume control is depressed beyond its normal relationship to engine speed, so that the roller is lifted from the cam defining minimum air/fuel ratios toward that defining maximum ratios where its further movement would be limited, causing the extension to revolve about its pivot on the arm against the bias of the spring.

5. A carburetor as claimed in claim 3 in which the linkage between the axis of the vane measuring air volume and the shaft controlling metering pump volume includes a cam surface rigidly mounted exterior of the body on the vane axis and having a roller contacting said cam mounted at the end of an arm which is pivoted on the body at the opposite end, said cam having a hinged abutment mounted on the cam which the roller must surmount when engine speed declines from fast to below normal idle, but which collapses under roller pressure when approached from the opposite direction due to increasing speed of engine start-up.

6. A carburetor as claimed in claim 5 in which the effect of the variables influencing the accuracy of air measurement are combined hydraulically and including an element compensating for low engine temperature, said combination being converted to mechanical motion and included as a percentage in the modulation of the metering pump as controlled by the movable wall of the variable orifice measuring air volume.

7. A carburetor for supplying a continuous mixture of air and finely divided fuels to an internal combustion engine having a fuel volume control comprising:

(a) a main body having an air inlet and a mixture outlet, a closed conduit connecting said inlet and outlet, and a valve in said outlet controlled by linkage to the engine's fuel volume control;

(b) a first shaft extending through said body;

(c) a movable vane in said conduit fixed to rotate on said shaft, the position of said vane defining the size of a variable orifice in said conduit;

(d) a spring for biasing said shaft against the direction of air movement to assume a minimum orifice size, but responsive to increasing air volume to enlarge orifice area and to move approximately in proportion to such air volume;

(e) a variable capacity rotary metering pump for measuring fuel volume driven at a constant speed housed in said carburetor body, the inlet of which is connected to a source of fuel under pressure and the discharge mixing with the metered air;

(f) a pump volume modulating shaft extending to the exterior of said body for controlling the displacement of said pump;

(g) air sensing means for detecting physical variables of the air whose variations effect carburetor operation and reflecting those variations by a physical movement of said means; and (h) a mechanical linkage operatively connected between said first shaft and said pump volume modulating shaft; said linkage including a gear type of differential through which the motion of the vane and the air sensing means can be arithmetically combined or totalized in the movement of the pump volume modulating shaft.

8. A carburetor as claimed in claim 7 in which the air sensing means comprises conventional means for detecting air temperature, barometric pressure, and humidity of the air entering the carburetor, converting these variations from a mean into mechanical motion, and combining these motions arithmetically by means of differential mechanism into the motion of a single element.

9. In a carburetor as claimed in claim 8 a mechanical linkage for combining the net output motion of said air sensing means into the motion of the shaft controlling modulation of the fuel metering pump, said mechanism consisting of a three element gear differential, the output of which is connected to the modulating means with one input element linked to the air measuring wall and the third controlled by the mechanical linkage on which the net output motion of the variables are combined.

10. In a carburetor as claimed in claim 9 including means for regulating the effect of said air sensing means for detecting physical variables on the modulation of the pump as a percentage of air volume passing through the carburetor comprising a cam integral with the differential input element linked to the vane, an arm with a roller attachment pivoted to said carburetor body and biased by a spring to maintain contact between said cam and said roller attachment, a groove along the linear axis of said arm pivot up to a maximum, a pin being positioned and actuated in the groove by linkage from the differential element on which the physical variables affecting air measurement are summarized, a slide with a slot, said pin extending through said slot and imparting to said slide a linear motion which is a product of the motion imparted by said cam and the motion imparted by the combined motions resulting from the physical variables, said slide having a rack segment engaging said differential input and thus transmitting its motion to the pump modulating means.

11. A carburetor for supplying a continuous mixture of air and fuel to an internal combustion engine having a fuel volume control comprising:

(a) a main body having an air inlet and a mixture outlet with a closed conduit connecting the two and a valve in said outlet controlled by linkage to the engine's fuel volume control means, said body also having an extension upon which is mounted an adjusting screw;

(b) a shaft, one end of which extends through said body wall;

(c) a vane in said conduit fixed to and rotatable on said shaft, said vane forming the movable element of a variable orifice for measuring the volume of air passing through said conduit, a variable capacity rotary metering pump for measuring fuel volume driven at a constant speed housed in said body and including a rotatable modulating shaft extending through the body wall;

(d) means associated with said metering pump modulating shaft for reducing fuel supply to the engine when decelerating above a predetermined engine speed consisting of a cup shaped first element with a rim having a depression, said first element further having a hub which is fixed rigidly to said pump modulating shaft and biased by a spring in the direction of minimum pump discharge, said element having a ratchet depression on its periphery and a lug which contacts said adjusting screw to form a stop when the pump displacement is at zero, a spring connected to said hub and biasing said pump modulating shaft in the direction of minimum pump discharge, a second element arranged to rotate concentric with the first consisting of a flanged cylinder having a first arm extending at right angle to its axis, said arm having a projection and said arm being linked to the air measuring means and moving with limited motion in said depression on the rim of said first element; a spring connecting the two elements and biasing said elements so that the arm normally rests at the end of the depression in the direction of minimum pump discharge under which condition both elements move in unison, a third element consisting of a cylinder with a second arm perpendicular to its axis at one end and arranged to rotate concentric with the first two elements, said third element being linked from its arm to said fuel volume control and actuated by its movement, and also having on said arm a pawl; a spring to bias said pawl in contact with the outer periphery of said first element and lock in with said ratchet when relative angular position is favorable, thus becoming associated in decreasing accelerator position and bringing the metering pump to zero output when there is no pressure on the fuel volume control and air volume is above a predetermined amount, and a bell crank pivoted on the carburetor housing adjacent to said elements and free to rotate with limited motion thereon, one arm being contacted by the projection on the arm of the second element when air intake falls below a predetermined volume and rotating the first and second arms so that a projection on the second arm disengages the pawl on said third element if it is locked in said ratchet thus releasing it to assume its normal position as controlled by the air measuring means.

12. A carburetor for supplying a continuous mixture of air and fuel to an internal combustion engine comprising a main housing, a shaft segment attached to said housing, a conduit with an inlet and outlet for the passage of air through said housing and enclosing means for the volumetric measurement of same which produces movement on the shaft segment exterior of the housing in rough proportion to air volume and with light mechanical force, a positive variable capacity rotary metering pump enclosed in said housing and including an internal shaft and a modulating shaft having a segment external of said housing, said pump having an inlet connected to a fuel supply line under pressure and discharging into the measured air stream, a linkage between said shaft segment and said metering pump modulating shaft whereby precise ratios of air and fuel may be maintained, and a constant speed electric motor, the stator of which is mounted to the carburetor housing and having a central rotatable shaft connected by a flexible coupling to the internal shaft of the metering pump.

13. A carburetor as claimed in claim 12 in which the electric motor driving the metering pump is adapted to be controlled by the ignition switch of a car.

14. A carburetor as claimed in claim 12 having a centrifugal air blower wheel mounted on the motor shaft and driven by it at constant speed, an air conduit connecting the inlet side of the blower wheel to the measured air in said air measuring housing, an inclosed scroll housing said blower wheel and a conduit from the discharge of said scroll terminating adjacent to the carburetor discharge, said conduits and scroll forming conduits for continuous forced air circulation while the carburetor is in use.

15. A carburetor as claimed in claim 14 having the discharge from the metering pump carried by a conduit terminating adjacent to the inlet of the blower wheel.

16. A carburetor as claimed in claim 15 having the discharge from the metering pump carried by two conduits spaced at ninety degrees and terminating adjacent to the blower wheel inlet.

17. A carburetor as claimed in claim 14 in which the conduit carrying the air discharged from the scroll terminates in at least one tube blanketing the area of the main carburetor discharge, said tubes perforated in a manner to give maximum uniformity to the resulting mixture.

18. A carburetor as claimed in claim 14 having a valve in said inlet air conduit to the blower wheel, said valve being actuated by linkage from the primary air measuring means and modulating the flow of air passing thru the conduit so the mixture leaving the blower wheel is always of the ratio for best ignition.

19. A carburetor as claimed in claim 18 in which a portion of the air/fuel mixture discharged from the blower wheel passes undiluted thru a separate conduit to the various initial combustion areas of the engine.

* * * * *